US007636955B2

(12) United States Patent
Plut

(10) Patent No.: US 7,636,955 B2
(45) Date of Patent: Dec. 29, 2009

(54) PROTECTIVE APPAREL BREATHING ASSISTANCE

(75) Inventor: William J. Plut, San Francisco, CA (US)

(73) Assignee: Cylena Medical Technologies Inc., Toronto (CA)

( * ) Notice: Subject to any disclaimer, the term of this patent is extended or adjusted under 35 U.S.C. 154(b) by 278 days.

(21) Appl. No.: 11/357,560

(22) Filed: Feb. 18, 2006

(65) Prior Publication Data

US 2006/0150305 A1 Jul. 13, 2006

(51) Int. Cl.
*A41D 13/00* (2006.01)

(52) U.S. Cl. ..... 2/457

(58) Field of Classification Search ..... 2/457, 2/901, 456, 458, 2.16, 272, 81, 84, DIG. 1; 128/201.29, 202.11, 201.22
See application file for complete search history.

(56) References Cited

U.S. PATENT DOCUMENTS

| | | | | | |
|---|---|---|---|---|---|
| 807,610 | A | * | 12/1905 | Ellis | 128/201.29 |
| 2,096,612 | A | * | 10/1937 | Freygang | 128/201.25 |
| 2,881,758 | A | * | 4/1959 | Motsinger | 128/201.25 |
| 3,113,320 | A | * | 12/1963 | Cherowbrier et al. | 2/81 |
| 3,208,080 | A | * | 9/1965 | Hirsch | 2/414 |
| 3,213,465 | A | * | 10/1965 | Ludwikowski | 2/87 |
| 3,248,738 | A | * | 5/1966 | Morgan | 2/462 |
| 3,525,334 | A | | 8/1970 | Braman | |
| 3,783,451 | A | * | 1/1974 | Malin | 2/4 |
| 3,955,570 | A | | 5/1976 | Hutter, III | |
| 4,055,173 | A | | 10/1977 | Knab | |
| 4,136,222 | A | * | 1/1979 | Jonnes | 428/116 |
| 4,195,364 | A | * | 4/1980 | Bengtsson et al. | 2/81 |
| 4,214,320 | A | | 7/1980 | Belkin | |
| 4,255,818 | A | | 3/1981 | Crowley | |
| 4,336,799 | A | | 6/1982 | Almasi | |
| 4,382,303 | A | | 5/1983 | Lunt | |
| 4,384,370 | A | | 5/1983 | Singer | |
| 4,504,977 | A | | 3/1985 | King | |
| 4,504,978 | A | | 3/1985 | Gregory, Jr. | |
| 4,523,335 | A | | 6/1985 | Scrivens | |
| 4,535,481 | A | | 8/1985 | Ruth-Larson | |
| 4,586,196 | A | | 5/1986 | White | |
| 4,651,727 | A | | 3/1987 | Howorth | |
| 4,653,120 | A | | 3/1987 | Leaf | |

(Continued)

FOREIGN PATENT DOCUMENTS

EP 490347 A1 * 6/1992

(Continued)

*Primary Examiner*—Danny Worrell

(57) ABSTRACT

Described herein is protective apparel that improves management. The protective apparel comprises a set of spacers. Each spacer is arranged on an inner portion of the apparel and maintains apparel proximate to the spacer distant from the person, thereby preventing continuous contact between the person and portions of the apparel. Multiple spacers may form one or more air channel between the spacers, the person and inner portions of the apparel. The channels permit low resistance airflow within the apparel and over the person's body. Low resistance airflow within the channels permits air to be easily moved through the apparel to cool the person. The spacers may comprise a compressible material such as foam. When the compressible material has an elastic memory, elastic return of the material causes each spacer to return to its initial shape after a deforming force is removed. Protective apparel described herein may also comprise a buffer volume of air that allows a person to breath without incurring significant pressure changes internal to the apparel.

19 Claims, 14 Drawing Sheets

U.S. PATENT DOCUMENTS 4,670,073 A 6/1987 Langley
4,674,132 A 6/1987 Stein
4,676,236 A 6/1987 Piorkowski
4,683,593 A 8/1987 Langley
4,766,614 A * 8/1988 Cantwell et al. ..... 2/414
4,937,881 A 7/1990 Heise
4,951,662 A 8/1990 Townsend, Jr.
4,969,215 A 11/1990 Burkett
4,986,282 A 1/1991 Stackhouse
5,005,216 A 4/1991 Blackburn
5,009,225 A 4/1991 Vrabel
5,033,115 A 7/1991 Bowling
5,042,474 A 8/1991 Williamson
5,046,492 A 9/1991 Stackhouse
5,054,480 A 10/1991 Bare
5,069,205 A 12/1991 Urso
5,097,534 A 3/1992 Viemeister
5,140,980 A 8/1992 Haughey
5,142,704 A 9/1992 Viemeister
5,142,706 A 9/1992 Layhon
5,214,797 A * 6/1993 Tisdale ..... 2/455
5,253,642 A 10/1993 Stackhouse
5,342,121 A 8/1994 Koria
5,414,867 A 5/1995 Bowling
5,467,481 A 11/1995 Srivastava
5,549,104 A 8/1996 Crump
5,560,974 A 10/1996 Langley
5,564,123 A 10/1996 Grassick
5,572,743 A 11/1996 Yavitz
5,588,153 A 12/1996 Ignon
5,592,936 A 1/1997 Thomas, Jr.
5,652,962 A 8/1997 Patnode
5,655,374 A * 8/1997 Santilli et al. ..... 62/3.5
5,690,095 A 11/1997 Glynn
5,704,670 A 1/1998 Surplus
5,705,251 A * 1/1998 Morman et al. ..... 428/114
5,711,033 A 1/1998 Green
5,794,276 A 8/1998 Walker
5,869,193 A 2/1999 Langley
5,887,281 A 3/1999 Green
5,901,376 A 5/1999 Deirmendjian
5,961,167 A 10/1999 Gilley
5,970,519 A * 10/1999 Weber ..... 2/81
5,991,921 A 11/1999 Saito
5,991,923 A 11/1999 Maria
6,014,971 A 1/2000 Danisch
6,062,444 A 5/2000 Tankersley
6,062,976 A 5/2000 De Guzman
6,115,839 A 9/2000 Covington
6,122,772 A 9/2000 De Guzman
6,209,144 B1 * 4/2001 Carter ..... 2/458
6,238,767 B1 5/2001 McCormack
6,241,134 B1 6/2001 Dunkel
6,378,136 B2 4/2002 Matsushita
6,393,617 B1 5/2002 Paris
6,427,883 B1 8/2002 Esten
6,442,760 B2 * 9/2002 Moretti ..... 2/115
6,481,019 B2 11/2002 Diaz
6,564,386 B2 5/2003 Fujikawa
6,610,163 B1 8/2003 Mathis
6,622,311 B2 9/2003 Diaz
6,799,331 B2 10/2004 Griesbach, III
2003/0111074 A1 * 6/2003 Alon et al. ..... 128/201.22
2003/0192537 A1 * 10/2003 Odell et al. ..... 128/201.22
2005/0011517 A1 * 1/2005 Steinert ..... 128/202.19
2006/0026743 A1 * 2/2006 Farnworth et al. ..... 2/455
2006/0048291 A1 * 3/2006 Sims ..... 2/456

FOREIGN PATENT DOCUMENTS

EP 843975 A1 * 5/1998
GB 2248174 A * 4/1992

* cited by examiner

PROTECTIVE APPAREL BREATHING ASSISTANCE

CROSS-REFERENCE TO RELATED APPLICATION

This application claims priority under U.S.C. §120 from co-pending U.S. patent application Ser. No. 10/887,648, filed Jul. 9, 2004 and entitled, "PROTECTIVE APPAREL SPACERS AND LOW RESISTANCE AIRFLOW", which is incorporated herein for all purposes and which claimed priority under 35 U.S.C. §119(e) from: a) U.S. Provisional Patent Application No. 60/486,274 filed Jul. 10, 2003, b) U.S. Provisional Patent Application No. 60/486,150 filed Jul. 10, 2003, c) U.S. Provisional Patent Application No. 60/486,232 filed Jul. 10, 2003, d) U.S. Provisional Patent Application No. 60/486,225 filed Jul. 10, 2003, e) U.S. Provisional Patent Application No. 60/486,151 filed Jul. 10, 2003, f) U.S. Provisional Patent Application No. 60/486,155 filed Jul. 10, 2003, and g) U.S. Provisional Patent Application No. 60/486,073 filed Jul. 10, 2003, each of these provisional patent applications is incorporated by reference herein for all purposes.

BACKGROUND OF THE INVENTION

This invention relates to protective apparel. More particularly, the present invention relates to protective apparel that improves thermal management for its wearer.

Protective apparel is used in many environments that offer an undesirable agent. Surgeons frequently operate on a patient who carries a communicable disease. Recent worldwide outbreaks of severe acute respiratory syndrome (SARS) have required health care practitioners to interact with patients that are knowingly afflicted. Practitioners in medical environments such as these are prone to contamination from airborne, blood-borne and droplet-transmitted biological agents. Industrial and chemical environments also offer a variety of airborne, liquid and solid hazards. Protective apparel is also used in applications such as clean rooms and surgical rooms to maintain a sterile zone and prevent passage of contaminants from the person wearing the apparel to a sterile zone or patient.

Many health-care workers have adopted surgical apparel for protection. Ventilation for conventional surgical suits frequently relies on an elaborate headgear apparatus comprising a fan and motor assembly to cool the wearer's face and head only. The fan does not sufficiently cool the person's body, where the majority of heat is generated. Thermal discomfort is a repeated complaint for conventional protective apparel. In addition, the surgical suits are designed and mainly used by surgeons standing in one location. If the user walks considerably or performs other regular physical tasks, the extra heat generated is not managed—and additionally raises discomfort.

Some situations require the protective apparel to be worn for prolonged periods. Nurses, for example, may wear protective apparel for up to eight hours. Prolonged usage of thermally inadequate apparel amplifies discomfort.

Conventional surgical suits are not intended for prolonged use by mobile individuals. Similar thermal management issues are found in clean room suits that lack an effective means for managing heat. Based on the foregoing, it should be apparent that alternative protective apparel would be desirable.

SUMMARY OF THE INVENTION

The present invention relates to protective apparel that improves thermal management. The protective apparel comprises a set of spacers. Each spacer is arranged on an inner portion of the apparel and maintains apparel proximate to the spacer distant from the person, thereby preventing continuous contact between the person and portions of the apparel. Multiple spacers may form one or more air channel between the spacers, the person and inner portions of the apparel. The channels permit low resistance airflow within the apparel and over the person's body. Low resistance airflow within the channels permits air to be easily moved through the apparel to cool the person.

The spacers may comprise a compressible material, such as foam. The compressible material reduces forces on the person resulting from contact with an external object. When the compressible material has an elastic memory, elastic return of the material causes each spacer to return to its initial shape after a deforming force is removed. The elastic return thus permits contact between the person or apparel and an external object without compromising airflow and heat management benefits over an extended period of time. This is useful for healthcare practitioners that frequently come in contact with objects such as beds; and when performing actions that require bodily contact, such as nursing assistance of an elderly patient.

In one aspect, the present invention relates to protective apparel. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a hood that includes a viewing window configured to rest in front of the person's face when the person wears the apparel. The protective apparel additionally comprises a set of spacers. Each spacer in the set includes a first portion that attaches to an inner portion of the shroud material and a second portion configured to neighbor a portion of the person when the person wears the apparel. Each spacer is also configured to maintain shroud material proximate to the spacer distant from the portion of the person.

In another aspect, the present invention relates to protective apparel that permits low resistance airflow within portions of the apparel. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a hood that includes a viewing window configured to rest in front of the person's face when the person wears the apparel. The protective apparel additionally comprises a set of spacers. The set of spacers is configured to form at least one air channel that is bordered by the person, a portion of a shroud material included in the apparel and two spacers in the set of spacers. Each spacer in the set includes a first portion that attaches to an inner portion of the shroud material and a second portion that configured to neighbor a portion of the person when the person wears the apparel. Each spacer in the set is also configured to maintain shroud material proximate to the spacer distant from the portion of the person.

In yet another aspect, the present invention relates to protective apparel that permits low resistance airflow in the apparel. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a set of chest spacers arranged to neighbor the person's chest when the person wears the apparel and configured to maintain shroud material proximate to each chest spacer distant from the person's chest when the person wears the apparel. The apparel additionally comprises a set of shoulder spacers arranged to neighbor the person's shoulders when the person wears the apparel and configured to maintain shroud material proximate to each shoulder spacer distant from the person's shoulders when the person wears the apparel.

Protective apparel described herein may also comprise a buffer volume of air that allows a person to breath without incurring significant pressure changes. The buffer volume comprises space internal to the apparel between the person and inner surfaces of the apparel.

In another aspect, the present invention relates to protective apparel. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a hood that includes a viewing window configured to rest in front of the person's face when the person wears the apparel. The protective apparel additionally comprises a buffer volume of air within the body portion that includes a volume of at least about four liters. The protective apparel additionally comprises an air channel between a space inside the hood and the buffer volume.

In still another aspect, the present invention relates to a method of maintaining an environment internal to protective apparel. The method comprises creating a buffer volume of air within a body portion of the apparel. The body portion covers at least a portion of the person's torso when the person wears the apparel. The buffer volume includes a volume of at least about four liters. The method also comprises creating an air channel between a space inside a hood included in the apparel and the buffer volume. The method further comprises providing air from outside the apparel into the buffer volume. The method additionally comprises maintaining the air channel between the space inside the hood and the buffer volume during an inhalation by the person.

In another embodiment, the protective apparel comprises an airflow directing spacer that maintains shroud material proximate to the spacer distant from the person, thereby preventing continuous contact between the person and portions of the shroud material. The airflow directing spacer also directs airflow within the apparel. The protective apparel may also comprise a blower arranged proximate to an aperture in the shroud material such that the blower moves air though the aperture. The airflow directing spacer is then arranged relative to the aperture to achieve a desired airflow in the apparel.

In another aspect, the present invention relates to protective apparel. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a hood that includes a viewing window configured to rest in front of the person's face when the person wears the apparel. The protective apparel additionally comprises an airflow directing spacer. The airflow directing spacer includes a first portion that attaches to an inner portion of shroud material included in the apparel and a second portion configured to neighbor a portion of the person when the person wears the apparel. The airflow directing spacer is configured to maintain shroud material proximate to the spacer distant from the portion of the person. The airflow directing spacer is also configured to direct airflow within the apparel.

These and other features of the present invention will be presented in more detail in the following detailed description of the invention and the associated figures.

Before committing to the Detailed Description, it may facilitate understanding to clarify certain words and phrases used in this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, be proximate to, be bound to or with, have, have a property of, or the like. Support and definitions for certain words and phrases are provided throughout this patent document, and those of ordinary skill in the art should understand that in many, if not most instances, such support applies to prior, as well as future uses of such words and phrases.

DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
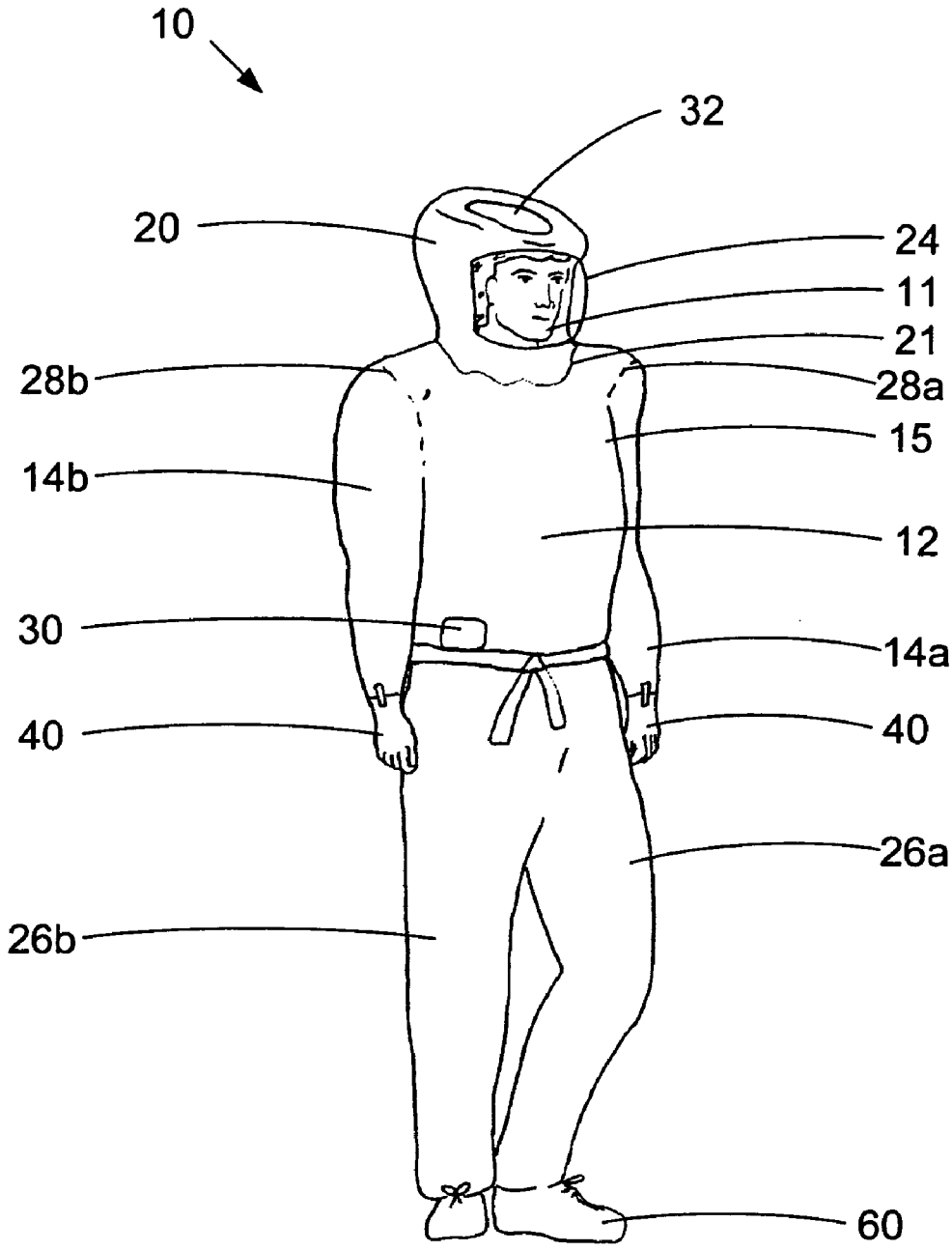
FIG. 1 illustrates a front elevation view of protective apparel in accordance with one embodiment of the present invention.

Protective apparel described herein includes a set of spacers that maintain apparel proximate to the spacers distant from the apparel wearer. FIG. 1 illustrates an outer front elevation view of protective apparel 10 in accordance with one embodiment of the present invention. While the present invention will now be described as protective apparel useful for improving heat management for its wearer, those skilled in the art will recognize that the subsequent description may also illustrate methods and discrete actions for improving heat management for an apparel wearer.

Apparel 10 generally refers to a garment assembly for use by a person 11. Apparel 10 comprises multiple components that are attached to form the garment assembly. As shown in FIG. 1, apparel 10 comprises body portion 12, sleeves 14, hood 20, pant legs 26, gloves 40 and boots 60. Apparel 10 also comprises a headgear assembly (FIGS. 4A and 4B) within hood 20, filters 30 and 32, and spacers (FIGS. 2A-3D). Materials suitable for each component are described below, in addition to description of suitable techniques for attaching the different components. In one embodiment, apparel 10 resembles a garment assembly or full-body suit that covers the entire body of person 12. In this case, apparel 10 creates an environment internal to apparel 10 and separates the internal environment from an environment external to apparel 10. In another embodiment, apparel 10 resembles a gown with an open bottom and no pant legs 26. The open gown may extend to the person's waist, ankles, or any height therebetween. Filters 30 and 32 regulate air and particulate passage through specific portions of apparel 10, while a blower neighbors one of the filters to supply fresh air into apparel 10 for breathing and/or cooling.

Shroud material 15 provides the main physical barrier between the environment internal to apparel 10 and the environment external to apparel 10. Shroud material 15 comprises a relatively thin, flaccid or semi-flaccid sheet. Shroud material 15 is included in most components of apparel 10, such as body portion 12, sleeves 14, pant legs 26, boots 60, and hood 20. In one embodiment, apparel 10 is designed to loosely fit about person 11. In this case, shroud material 15 loosely fits about person 11. In a specific embodiment, apparel 10 employs a single type of material for shroud material 15. In other cases, portions of apparel 10 may include different types of shroud material. For example, body portion 12 may include a substantially liquid impervious material while sleeves 14 include a lighter material that provides lesser protection, while hood comprises a separate material that increases breathability between the environment internal to apparel 10 and the external environment.

Body portion 12 includes shroud material 15 and covers at least a portion of the person's torso. For the embodiment shown in FIG. 1, body portion 12 extends perimetrically about the person's torso and downward from the person's shoulders to below the person's groin, thereby shrouding substantially the full torso. In one embodiment, body portion 12 may extend downward from the shoulders to the waist of person 11, or may extend lower than the waist to the knees, the ankles, a point between the thighs and knees, or a point between the knees and ankles. In one embodiment, body portion 12 includes no seams in the front hemisphere to provide a frontal piece that minimizes risk of penetration from liquid or other undesirable agents at a seam. As mentioned above, apparel 10 may resemble a gown where body portion 12 includes an open bottom and apparel 10 includes no pant legs 26.

Hood 20 substantially covers the wearer's head 85 and neck; and comprises hood shroud material 15 and a viewing window 24. A lower portion of the hood shroud material 15 attaches to an upper portion of body portion 12 at seam 21. Viewing window 24 is configured to rest in front of the person's face when person 11 wears apparel 10. Viewing window 24 allows person 11 to see out of hood 20. Viewing window 24 comprises a thin, lightweight and transparent barrier, such as a suitable plastic. In one embodiment, shroud material 15 included in hood 20 attaches to viewing window 24 about the perimeter of viewing window 24. Shroud material of hood 20 and viewing window 24 may be attached by taping, sewing, or with a suitable adhesive, for example. In one embodiment, shroud material 15 hangs from headgear assembly 80 (FIG. 4B) and viewing window 24 is configured to hang in front of a forward facial section of head 85 when person 11 wears apparel 10. One or more spacers may be attached to a bottom portion of viewing window 24, or to shroud material below viewing window 24, to maintain a distance between the bottom portion of viewing window 24 and person 11. Viewing window 24 may curve about the person's face to increase unobstructed viewing for person 11. In one embodiment, window 24 curves about the person's face and ends in front of the person's ears. In this case, shroud material 15 included in hood 20 is provided with slack such that person 11 may use a stethoscope while wearing apparel 10.

Figure 4A:
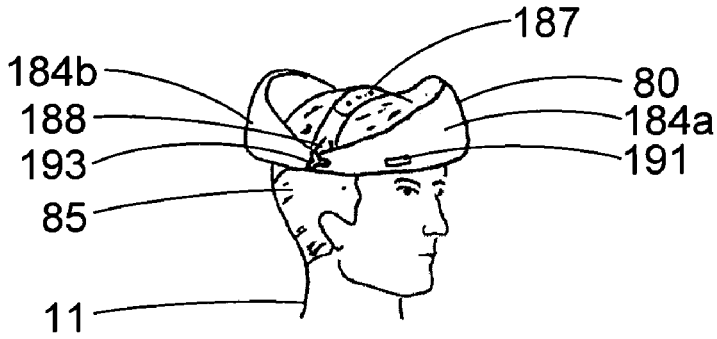
FIG. 4A illustrates a side elevation view of a headgear assembly disposed within the hood of the apparel shown in FIG. 1 in accordance with one embodiment of the present invention.
Figure 4B:
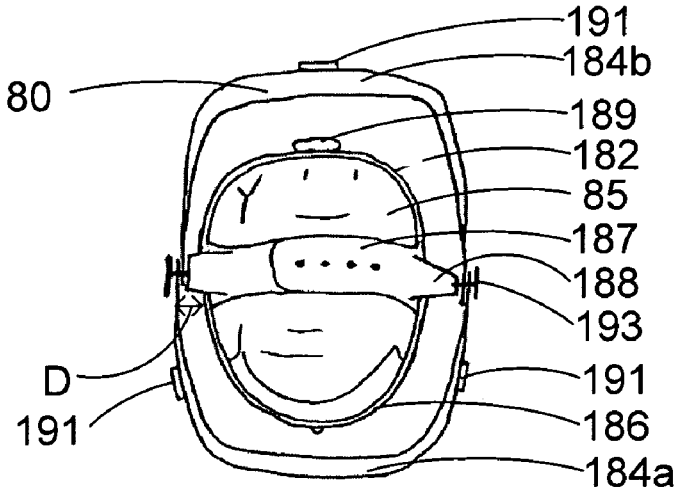
FIG. 4B illustrates a top view of the headgear assembly of FIG. 4A in accordance with one embodiment of the present invention.

FIG. 4A illustrates a side elevation view of a headgear assembly 80 disposed within hood 20 in accordance with one embodiment of the present invention. FIG. 4B illustrates a top view of headgear assembly 80. Headgear assembly 80 rests upon the head 85 of person 11, lies underneath material of hood 20, and maintains shroud material 15 and viewing window 24 at a distance from head 85. Headgear assembly 80 includes a head interface 182 and spacing guards 184.

Head interface 182 comprises a headband 186, support 187 and one or more spacing members 188. Headband 186 circumferentially surrounds head 85 and fits to prevent rotational motion between assembly 80 and head 85. Headband 186 includes an adjustable fastener 189, usually in the back of headband 186, that allows person 11 to change the circumference of headband 86. Fastener 189 may include a ratcheting fastener, a hook and loop fastener (commonly marketed under the trademark name 'Velcro'), or dual arms having mating plastic features that snap together and hold the arms together.

Support 187 attaches to headband 186 on one side of head 85, extends over the top of head 85 when the person wears headgear 80, and attaches to headband 186 on the other side of head 85. Support 187 provides vertical support to bear the weight of headgear assembly 80, shroud material 15 for hood 20, and viewing window 24. Support 187 includes dual arms having mating and adjustable plastic features that allow the person to adjust fit for the top support 187. In one embodiment, support 187 and headband 186 include a slightly compliant material to minimize any localized forces on head 85 and/or a soft padding attached to the underside to increase user comfort (such as foam band or cotton). Although FIG. 4A is illustrated with one support 187 extending over head 85, it is understood that headgear assembly 80 may include a larger number of supports, such as from 2 to 5. In another embodiment, supports 187 comprise a continuous net that extends over the entire head 85 while still allowing for gaseous communication with the top of head 85 for heat dissipation.

Forward spacing guard 184*a* and rear spacing guard 184*b* define the external dimensions of headgear assembly 80. Spacing guards 184 comprise rigid members shaped to contour around the person's head and maintain shroud material 15 from contacting head 85. Spacing guards 184 thus largely define an amount of space between the inner surface of shroud material 15 (or viewing window 24) and head 85 for hood 20. Spacing guards 184 attach to shroud material 15 at one or more places on its perimeter. As shown, male ends of a hook and loop fastener 191 are disposed in three places on spacing guards 184 to attach to mating females pieces on shroud material 15 in hood 20 (not shown). Spacing guards 184 thus position and support hood 20 and bear of the weight of shroud material 15 and viewing window 24. Spacing guards 184 also define the vertical cross-section shape of hood 20 (FIG. 4B). In one embodiment, spacing guards 184 are configured to substantially follow the generally oval contours of the human head. Shroud material 15 drops down from spacing guards 184 according to the contour of spacing guards 184.

Spacing members 188 extend down from support 187 and separate spacing guards 184 laterally from head interface 182. Spacing members 188 maintain spacing guards 184 in position relative to head 85 and thus help establish the amount of space between the inner surface of shroud material 15 and head 85 for hood 20. Spacing members 188 each connect a) at their proximate end to head interface 182, and b) at their distal end to a portion of spacing guards 184. Screws 193 are used to attach spacing guards 184 to each spacing member 188 on either side of the person's head 85. As shown, headgear assembly 80 includes two rigid members 188 symmetrically disposed on opposite sides of head 85. It is understood that a different number of members 188 may be used.

Since shroud material 15 is flaccid and drapes from spacing guards 184, headgear assembly 80 is then configured such that shroud material 15 is spaced above and away from head 85 to provide room for airflow around head 85. Spacing guards 184 also include a height that extends above head 85 to allow for space between material 15 and head 85 above the top of head 85. Thus, neither spacing guards 184 nor shroud material 15 supported by spacing guards 184 continuously contact head 85 during usage of apparel 10. This arrangement permits airflow, breathing circulation and cooling circulation around head 85 with minor resistance. In one embodiment, headgear assembly 80 is dimensioned to maintain an average or minimum distance, D, between shroud material 15 and head 85 (FIG. 4B). An average or minimum distance from about ½ inch to about 4 inches is suitable in some applications. In another embodiment, headgear assembly 80 is dimensioned such that the inner surface of shroud material 15 is, on average or minimum, from about 1 inch to about 2 inches away from head 85. In some cases, slack in shroud material 15 combines with positive pressure from a blower in apparel 10 to expand slack material 15 away from head 85 and thereby create additional space between shroud 15 and head 85. In this case, shroud 15 may rest even further from head 85 than provided passively by headgear assembly 80. Headgear assembly 80 preferably comprises lightweight materials so as to minimize encumbrance on person 11. For example, rigid members of spacing members 184 may comprise a lightweight and stiff plastic. In a specific embodiment, headgear assembly 80 comprises two Willson V5N series headgear browguards assembled to one V5N series head interface as provided by Bacou Dalloz USA Inc. of Smithfield, R.I.

Returning back to FIG. 1, left and right sleeves 14*a* and 14*b* include shroud material 15 and integrally attach to a shoulder portion of body portion 12 at seams 28*a* and 28*b*, respectively. In another embodiment, the entire front portion of apparel 10 is constructed from a single piece of material and seams 28 do not exist between body portion 12 and sleeves 14 as shown. Sleeve 14*a* receives a left arm of person 11; and left sleeve 14*b* receives a right arm of person 11. While sleeves 14 are illustrated as extending up to the shoulder of person 11, it is understood that different designs and assemblies if apparel 10 will vary the extent of arm coverage provided by each sleeve 14. At the least, each sleeve 14 receives a portion of an arm, such as the forearm to the wrist. Seams 28 connect the separate pieces of shroud material 15 included in body portion 12 and sleeves 14; and may include stitching, tape, an ultrasonic seal and/or a heat seal, depending on the materials being connected and a desired level of protection.

Gloves 40 are worn at the distal end of each arm. In one embodiment, gloves 40 comprise a gaseous and liquid impermeable material such as polyethylene, latex, rubber, or the like. The person may tape or otherwise temporarily attach gloves 40 to sleeves 14. Attaching gloves 40 to sleeves 14 allows person 11 to remove apparel 10 as a single unit. In a specific embodiment, apparel 10 is provided with handwear integrally attached to the distal end of sleeves 14 that facilitates removal of gloves 40 worn over the handwear. The handwear is configured such that when a user doffs the handwear and outer glove 40, the handwear restrains the outer glove 40. Thus, when a user pulls the handwear and outer glove inside-out, the handwear may capture and contain the outer glove, which allows person 11 to remove apparel 10 as a single unit.

Left and right pant legs 26*a* and 26*b* include shroud material 15 and attach to a lower portion of body portion 12 at seams (not shown). In another embodiment, the entire front portion of apparel 10 is made from a single piece of material and seams do not exist between body portion 12 and pants legs 26. As shown in FIG. 1, pant legs 26 extend from body portion 12 from the midpoint of the person's thighs. In this case, each pant leg 26 only receives a portion of each leg from the thigh to the foot. As mentioned above, body portion 12 may extend down to a different part of person 11, such as the waist or the knees or below, which will determine the length of pant legs 26.

In the embodiment shown in FIG. 1, pant legs 26 extend and enclose the feet or shoes of person 11. Boots 60 attach to the distal ends of each pant leg 26. Boots 60 cover at least a portion of the shoes worn by person 11 and may include an abrasion resistant material on a bottom surface. One or more ties, rubber bands or elastics sewn into shroud material 15 may be used to secure excess material included in boots 60. The excess material assists user entry and exit into and out of boots 60. Plastic tape, hook and loop fasteners, male and females snaps, or other detachable binders may also be used other than ties or elastics to secure excess material of boots 60.

A filter 30 is sewn or otherwise suitably attached to shroud material 15 about a hole in shroud material 15 at a lower area of body portion 12. A blower (not shown) is arranged on the inside of apparel 10 to neighbor inlet filter 30. The blower moves air from the environment external to apparel 10 into the environment internal to apparel 10. Air provided by the blower ventilates the environment internal to apparel 10, cools the person wearing apparel 10 and provides fresh air for breathing. The blower may comprise a fan or other air moving apparatus suitably sized to provide a desired flow rate of air into and/or within apparel 10. Generally, the blower capacity should be sufficient to draw air into apparel 10, through inlet filter 30, and out of apparel 10 at an air flow rate sufficient for respiration and/or cooling of person 11. In one embodiment, an inlet airflow rate from about 5 to about 80 cubic feet per minute (c.f.m.) is suitable. In another embodiment, an inlet airflow rate from about 5 to about 20 c.f.m. is suitable. Larger and smaller airflow rates may be suitable depending on a number of factors, such as the size of apparel 10 and the number of blowers employed. The blower may comprise any conventional fan mechanism and may be powered by a rechargeable battery. Such devices are commercially available from a wide variety of vendors known to those of skill in the art. In a specific embodiment, the blower comprises a D series fan as provided by Pelonis Technologies Inc. of Malvern Pa. In one embodiment, person 11 wears a belt under apparel 10 that supports the blower next to filter 30. In another embodiment, mating hook and loop fasteners are used to attach the blower to shroud material 15 adjacent to filter 30 during usage.

Inlet filter 30 intercepts air before flow into apparel 10 and selectively regulates the passage of air and any particulates in the air, such as any undesirable agents, into apparel 10. In one embodiment, inlet filter 30 comprises a fabric that provides a minimal pressure drop for the blower. The inlet filter 30 material and type may also be varied according to the undesirable agent(s) to be selectively blocked for apparel 10. In another embodiment, inlet filter 30 comprises a sub-micron filter that has an effective porosity such that particles greater than a micron are not permitted to pass through. A HEPA rated filter may also be employed. Such filters are commercially available from vendors known to those skilled in the art. One suitable provider of bacterial and viral filters is Pall Canada Ltd. of Mississauga, Canada.

As shown in FIG. 1, inlet filter 30 is disposed in front of apparel 10 to provide air inlet to the front portion of apparel 10. Alternatively, filter 30 (and the neighboring blower) may be disposed in back of apparel 10, on a side of apparel 10, or in upper portions of apparel 10. In a specific embodiment, filter 30 is located just below a belt (not shown), which allows person 111 to constrict the diameter of apparel 10 about the waist of person 11. In another specific embodiment, filter 30 is located in the upper back region of apparel 10 to allow inlet air to proceed immediately towards hood 20 to facilitate breathing. Apparel 10 may also include multiple inlet filters and blowers, such as a second filter 30 disposed on the backside of apparel 10. In this case, airflow suitable for respiration and cooling may be divided among the multiple inlets.

Air filter 32 exhausts air from an environment internal to apparel 10 to an environment external to apparel 10. Filter 32 is attached material about a hole in the shroud material 15 by sewing, taping, adhesive, etc. As shown in FIG. 1, outlet filter 32 forms a major portion of the top surface of hood 20. In another embodiment, a second filter 32 forms a large fraction of shroud material 15 on the backside of hood 20. Outlet filters 32 may also be included in other portions of apparel 10, such as the top of the person's shoulders, lower or middle regions of body portion 12, in sleeves 14 and/or in pant legs 26.

Inlet filters 30 and outlet filters 32 may be arranged to specifically move air along desired paths within apparel 10 or to draw airflow to a certain area within apparel 10. For example, an inlet filter 30 may be located within or near hood 20 to immediately provide air to this area, while one or more outlet filters are disposed at the waist of apparel 10 (e.g., switch the locations of inlet filter 30 and outlet filter 32 as shown). This arrangement creates a positive pressure about the head 85 and respiratory areas for person 11 and is well-suited for applications that desire positive-pressure respiratory apparel.

Multiple inlet and outlet filters may also be sized and arranged to achieve a desired airflow distribution. In one embodiment, inlet filters 30, associated blowers and outlet filters 32 are arranged such that at least 50 percent of the of inlet air volume first moves to hood 20 for breathing. In another embodiment, outlet filters 32 in a designated portion of apparel 10 are responsible for at least 50 percent of the of outlet air volume from apparel 10 and the shroud material 15 is breathable and passively exhausts the remainder. In another embodiment, outlet filters 32 are responsible for at least 75 percent of the of outlet air volume from apparel 10.

Inlet and outlet filters may also be configured to direct air for cooling of person 11. Thus, inlet and outlet filters may located and configured to increase airflow and cooling across the torso, neck and head of person 11, which are generally considered priorities for human thermoregulation. For example, air entering an inlet filet 30 in or near hood 20 to increase fresh air supply for breathing may subsequently pass along the body of person 11 for cooling before exhausting from a waist disposed outlet filter 32. In one embodiment, outlet filters 32 comprise the same filter material that is used in inlet filters 30. Correspondingly, brief pressure fluctuations, e.g., those resulting from breathing or movement within apparel 10, do not result in passage of undesirable agents from an environment external to apparel 10 through an intended outlet filter 32 and into the environment internal to apparel 10.

While the present invention has primarily referred to inlet filters that prevent undesirable agents from passing into apparel 10, it is understood that applications such as clean rooms and surgical rooms require apparel and filters that prevent escape of the undesirable agents. In this case, outlet filters 32 selectively transmit air and contaminants moving from the environment internal to the apparel to a clean environment outside the apparel, such as filtering out bacteria and microorganisms carried by person 11 to maintain a sterile zone for surgical applications.

Shroud material 15 typically comprises one or more relatively thin, flaccid sheets. Shroud material 15 forms a large portion of apparel 10 and is included in multiple parts of apparel 10 such as body portion 12, sleeves 14, pant legs 26, boots 60, and hood 20. The number of pieces of material 15 will depend on how apparel 10 is manufactured and assembled, as one skilled in the art will appreciate, and the present invention is not limited to any particular style, assembly or design of apparel 10. Usually, a single type of material is employed for shroud material 15, however, it is contemplated that multiple types of shroud material 15 may be used (e.g., one shroud material 15 for body portion 12 and another shroud material 15 for sleeves 14 and/or hood 20). In one embodiment, shroud material 15 comprises a breathable and selectively filtering material that prevents transmission of a targeted undesirable agent through shroud material 15. In another embodiment, shroud material 15 comprises a substantially air and/or liquid impermeable material, such as a suitable plastic or non-woven fabric. Shroud material 15 may also comprise a breathable or breathable and splash resistant material, such as a non-woven fabric. Breathable portions of material 15 may also operate as a filter for outlet of air from the environment internal to apparel 10 to the environment external to apparel 10. In addition, different materials may be added or combined to shroud material 15 to increase comfort, protection, strength, appearance or another property of apparel 10. For example, plastic materials may be combined with non-woven materials to increase protection. A commercially available material such as one of the Tyvek series as provided by DuPont of Wilmington, Del., is suitable for use in shroud material 15. A non-woven such as one of the Spunbond series as provided by Kimberly-Clark Health Care of Roswell, Ga. may also be suitable. In a specific embodiment, one of ProVent 1000, 3000, 7000, 7500 or 10,000 as provided by Kappler of Guntersville, Ala., is suitable for use. Shroud material 15 may also comprise a material based on polymers and copolymers of vinyl chloride, vinylidene chloride, ethylene, acrylic acids and esters, methacrylic acids and esters, propylene amines such as polyamides and other polymerizable monomers, cotton and silk, compressed nylon, polyester, and/or spandex (which may be used to increase user comfort and fit).

In general, seams of the present invention (such as seam 21 between hood 20 and body portion 12) may include sewing, taping, heat sealing, an adhesive and/or solvent or sonic welding. The specific joining technique used will depend on the two materials being joined, cost, manufacturing ease, and the desired joint strength, as one skilled in the art will appreciate. Multiple joining techniques may also be implemented, such as sewing for seal strength and heat-sealing for seal integrity.

In one embodiment, apparel 10 is airtight except for gaseous communication via inlet filters 30 and outlet filters 32. Apparel 10 then provides an isolated system in which air from the environment external to apparel 10 is transmitted into an environment internal to apparel 10 through inlet filters 30 and out through filters 32. Correspondingly, person 11 is isolated from the ambient environment except through controlled filtering. Air pressure within apparel 10 remains balanced based on the pressure drop across outlet filters 32 and influx pressure provided by the fan or blower. In some cases, apparel 10 is substantially impermeable to one or more undesirable agents. Impermeable as used herein refers to the quality not permitting passage. Thus, "impermeable to air or liquids" refers to a quality of substantially not permitting passage of air or liquids. "Impermeable to an undesirable agent" refers to substantially not permitting passage of the undesirable agent regardless of whether the agent is a solid particulate, gaseous or liquid substance.

In one embodiment, apparel 10 includes an aperture in the back of body portion 12 for donning and doffing. The aperture may be opened and closed with a zipper (not shown) and the zipper sealed internally with a flap (not shown) that covers the zipper and adheres to shroud material using plastic tape or mating hook and loop fasteners. In another embodiment, apparel 10 includes a transition portal to assist donning and doffing and to reduce the risk of cross-contamination when doffing. The transition portal attaches to the apparel proximate to one end of an aperture, which provides an exit for the protective apparel. When doffing, the transition portal extends away from the person, who exits the aperture. The transition portal is then pulled over the body along with any attached portions of the protective apparel. This turns the transition portal—and attached parts of the apparel—inside-out. After doffing, most portions of protective apparel are either a) inside-out, or b) contained within the inside-out transition portal and/or apparel. As a result, undesirable agents—that were initially on the outside of the apparel—are now inside the inside-out transition portal and apparel. Further description of a collapsible transition portal that facilitates donning and doffing is described in commonly owned patent application entitled "Protective Apparel with Improved Doffing", filed on Jul. 9, 2004, and naming William J. Plut et al. as inventors, which is incorporated by reference herein for all purposes.

To improve comfort and heat management for person 11, apparel 10 comprises a set of spacers that prevent continuous contact between person 11 and portions of apparel 10, such as shroud material 15. A set of spacers may be arranged to form air channels within apparel 10 that allow air to move through apparel 10 with relatively little resistance.

Figure 2A:
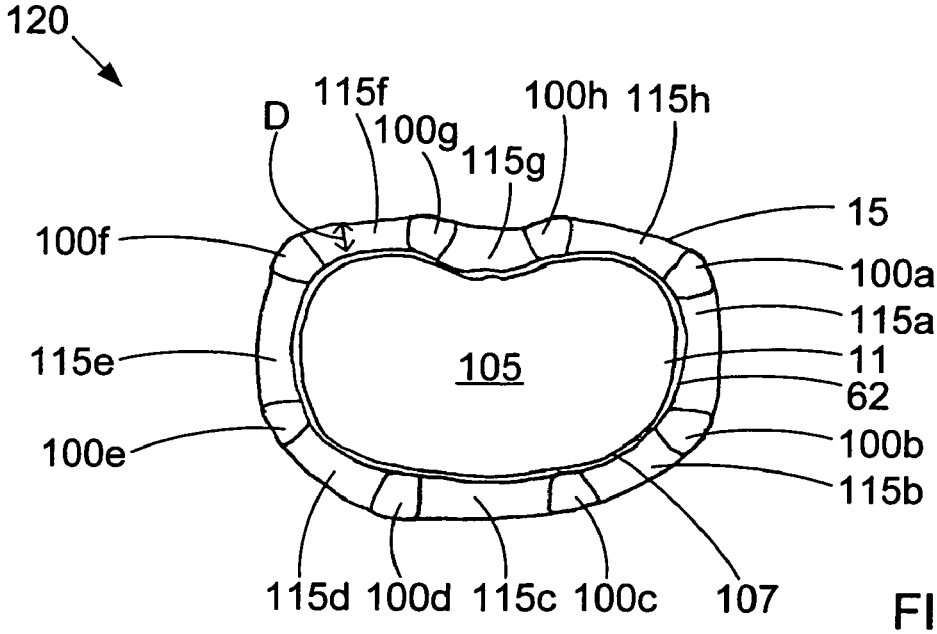
FIG. 2A illustrates a vertical cross section of the person and apparel of FIG. 1 taken through a chest region of the person in accordance with one embodiment of the present invention.
Figure 2B:
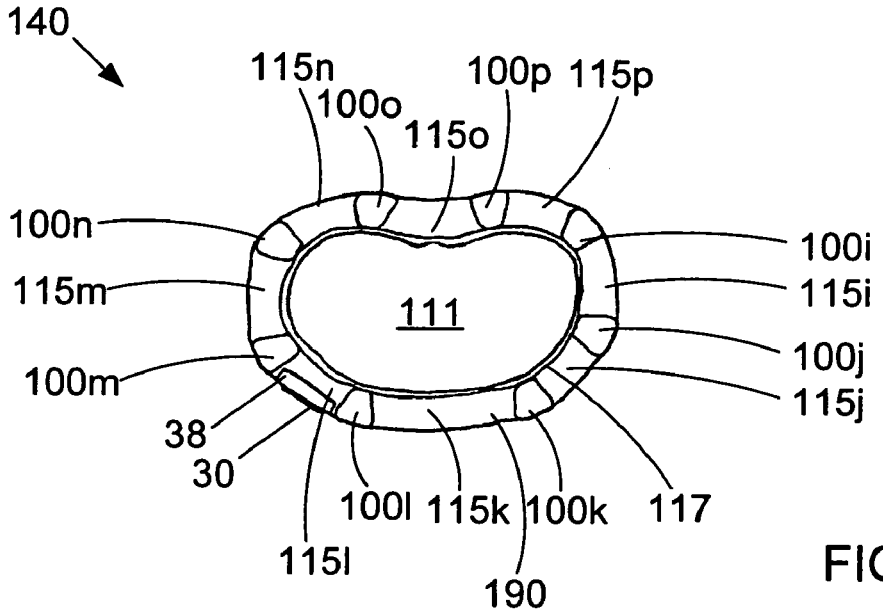
FIG. 2B illustrates a vertical cross section of the person and apparel of FIG. 1 taken through a waist region of the person in accordance with one embodiment of the present invention.
Figure 2C:
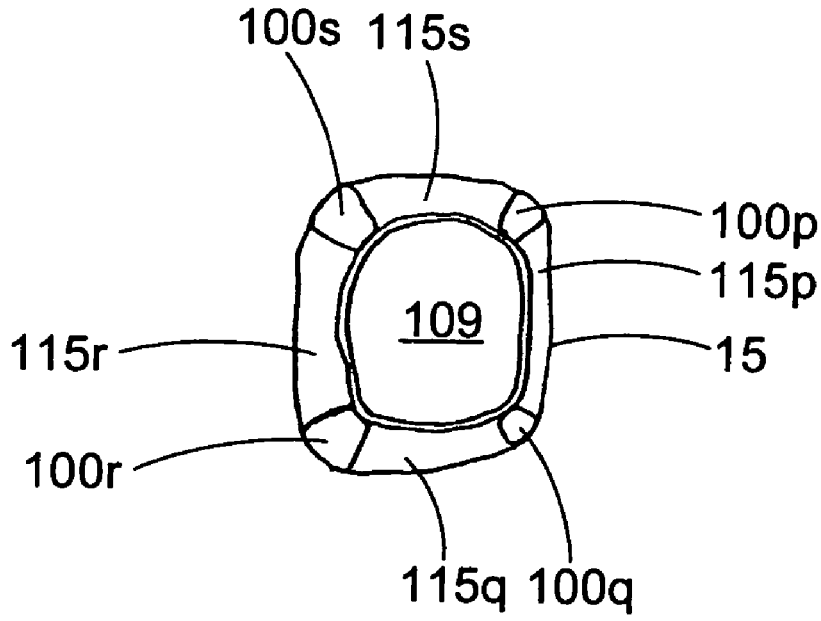
FIG. 2C illustrates a vertical cross section of the person and apparel of FIG. 1 taken through a thigh region of person in accordance with one embodiment of the present invention.

FIG. 2A illustrates a vertical cross section of person 111 and apparel 10 taken through a chest region 105 of person 11 in accordance with one embodiment of the present invention. FIG. 2B illustrates a vertical cross section of person 11 and apparel 10 taken through a waist region 111 of person 111 in accordance with another embodiment of the present invention. FIG. 2C illustrates a vertical cross section of person 11 and apparel 10 taken through a thigh region 109 of the person's right leg 130 in accordance with another embodiment of the present invention.

Figure 3A:
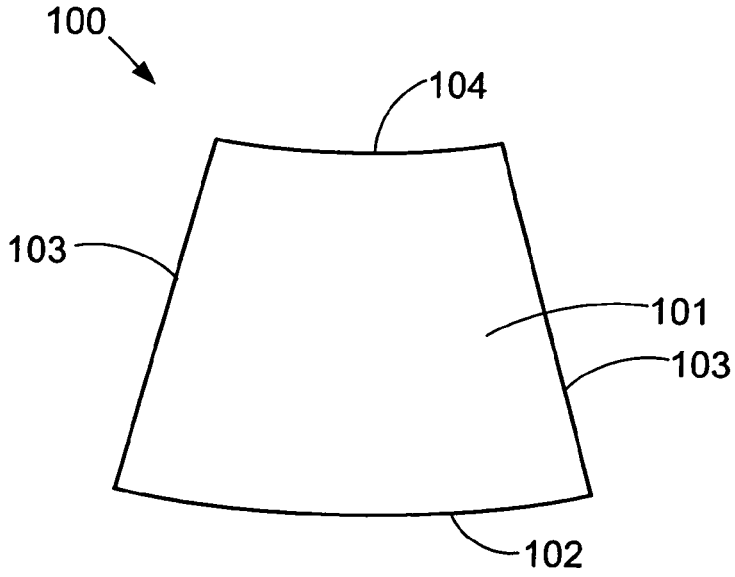
FIG. 3A illustrates a top view of a spacer used in the apparel of FIG. 1 in accordance with one embodiment of the present invention.
Figure 3B:
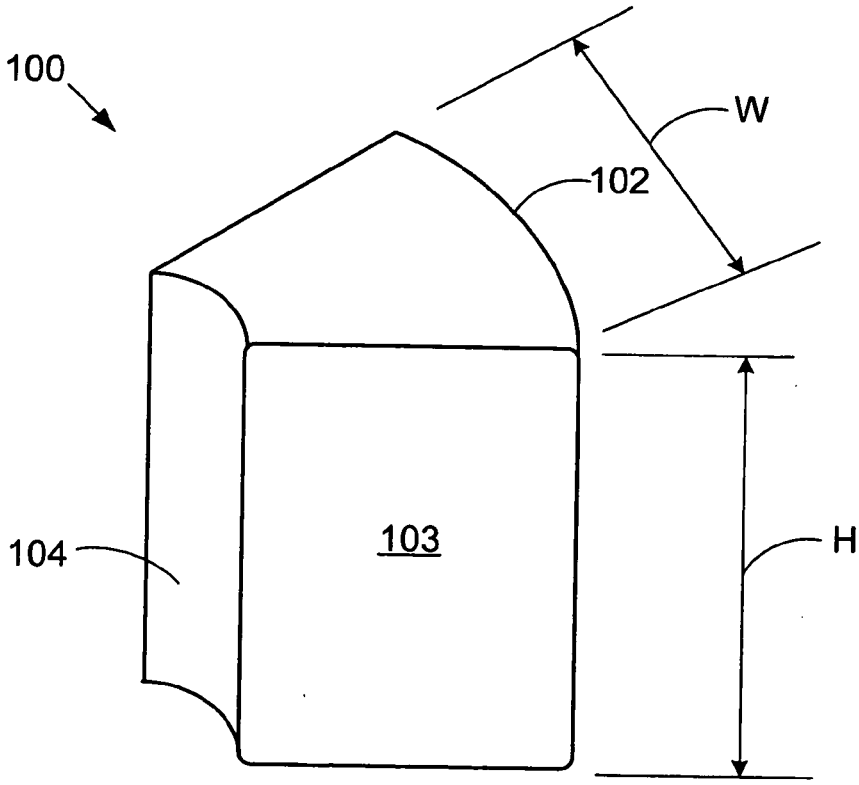
FIG. 3B illustrates a top perspective view of the spacer of FIG. 3A in accordance with one embodiment of the present invention.
Figure 3C:
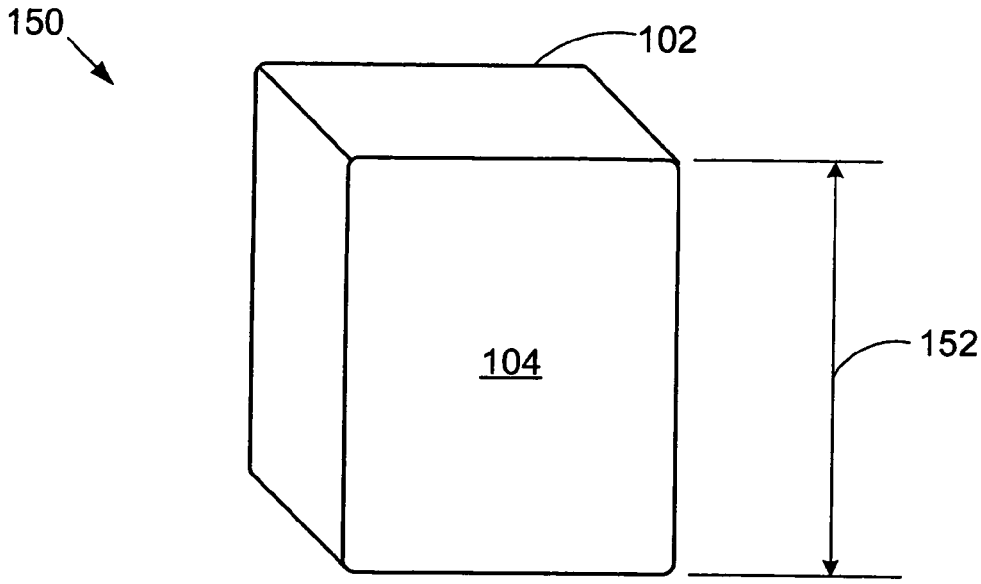
FIG. 3C illustrates a top perspective view of a spacer suitable for use in the apparel of FIG. 1 in accordance with another embodiment of the present invention.

FIG. 3A illustrates a top view of a spacer 100 in accordance with one embodiment of the present invention. FIG. 3B illustrates a top perspective view of the spacer 100. FIG. 3C illustrates a top perspective view of a spacer 150 in accordance with another embodiment of the present invention.

Referring to FIGS. 2A, 3A and 3B (or 3C), each spacer 100 (or 150) is configured to maintain shroud material 15 proximate to the spacer distant from an outer surface 107 of chest region 105 for person 11. Each spacer 100 includes a body 101 having a proximate portion 102 (FIG. 3A) that attaches to an inner portion of apparel 10 and a distal portion 104 (FIG. 3A) that neighbors chest region 105 when person 11 wears apparel 10. As shown in FIGS. 3A and 3B, each spacer 100 in apparel 10 has a truncated right rectangular shape with curved surfaces for distal portion 104 and proximate portion 102. Spacer 150 of FIG. 3C comprises a roughly rectangular block shape.

A portion of spacer 100 is referred to herein as proximate when it attaches to apparel 10, while a portion is referred as distal when it is arranged away from apparel 10. For spacer 100, proximate portion 102 is a surface, which attaches to shroud material 15 at a location on shroud material 15 such that spacer 100 neighbors a portion of person 11. In one embodiment, proximate portion 212 or 102 attaches to an inner surface of shroud material 15 by taping, sewing, or with a suitable adhesive, for example.

Distal portion 104 neighbors a portion of person 11 when person 11 wears apparel 10. Neighboring in this sense refers to lying near in position or location. Depending on the size of person 11, fit of apparel 10 and the temporary relationship between person 11 and apparel 10, distal portion 104 may be in contact with a portion of person 11 (or clothing 62 worn by person 11), closely situated thereto, or relatively removed therefrom. Often, person 11 wears a clothing layer 62 under apparel 10, such as a T-shirt. The clothing covers one or more portions of the person's body, such as a T-shirt that covers surface 107 of chest region 105. If arranged over a portion of person 11 proximate to a spacer 100, clothing 62 will contact distal portion 104 and not person 11 directly. For sake of discussion, portions of person 11 as described herein neighbored by a spacer include any clothing 62 worn by person 11. In one embodiment, apparel 10 is designed and configured such that each spacer 100 is closely situated or in contact person 11 when person 11 wears apparel 10. Since multiple spacers 100 attach to shroud material 15, which is generally flaccid, it is understood that each spacer 100 and its distal portion 104 may move relative to person 11. For example, shroud material 15 may be pulled away from person 11 as a result of motion by the person or an external force. This may temporarily remove a spacer 100 and distal portion 104 from contact with or close proximity to person 11. The apparel 10 and spacers 100 may then return to their initial position before the disturbance. In one embodiment, apparel 10 includes one or more straps or belts that allow person 11 to adjust fit for apparel 10, thereby maintaining one or more spacers 100 proximate to the belt closer to person 11.

In one embodiment, spacer 100 is compliant. The compliance may be achieved with a material having a stiffness suitable to maintain shroud material 15 and apparel 10 distant from person 11 while allowing compression of spacer 100 when a threshold force is applied to the spacer. To achieve compliance, body 101 of spacer 100 may comprise a compressible material, such as a compressible foam or sponge. Alternately, a cylindrical spacer 100 may include a compression spring axially arranged to deflect along the distance between its contact locations on person 11 and shroud material 15. In another embodiment, only a portion of spacer 100 is compliant. For example, a compressible foam or sponge layer may be attached to the surface of distal portion 104 to interface with the body of person 11. Compliance and compressibility of spacer 100 increases comfort for person 11 and reduces forces on person 11 resulting from contact with an external object.

In a specific embodiment, the compliant material has an elastic memory and spacer 100 substantially returns to its initial shape after a deforming force is removed from the spacer 100. A compressible foam with elastic return is suitable. For example, a closed cell polyethylene foam available from New Dimension Industries of Moonachie, N.J., is well suitable for use with compressible spacers 100 in apparel 10. The foam may be dimensioned to a desired spacer shape, examples of which are described below. One of skill in the art will appreciate that a wide range of foams and materials offer a suitable stiffness range that allows portions of apparel 10 to maintain a distance from person 11 while providing compliance and elastic return to external deforming forces. The packaging industry, for example, relies on numerous foams that are tailored in stiffness for a particular application, such as closed cell polyethylene and polyurethane.

Compliance and elastic return of spacer 100 permits contact between person 11 or apparel 10 and an external object without compromising airflow and heat management benefits of apparel 10 over an extended period of time. This is useful for a health care practitioner wearing the apparel for prolonged periods in a surgical environment in which the practitioner intermittently leans against the operating table or bed. Alternatively, the compliance and elastic return is useful for individuals working in a clean room such as a semiconductor manufacturing facility where the individuals are required to perform dexterous duties while leaning and coming into contact with solid objects. Further, this is useful for nurses that frequently perform actions that require bodily contact, such as assisting an elderly patient. The compliance and compressibility of spacers 100 also reduces any lack of mobility that might be caused by the extra space associated with apparel 10, which is larger than the person alone, since the wearer may temporarily compress portion of the apparel that might inhibit movement.

FIG. 2A illustrates an exemplary set of spacers 120 as arranged circumferentially about a chest region 105 of person 11 when the person wears apparel 10. The set of spacers 120 comprises eight spacers 100*a-h*: four spacers 100*b-e* in the front hemisphere of person 11 and four spacers 100*a* and 100*f-h* in back. Distal portions of each spacer 100 neighbor surface 107 in chest region 105. In the absence of a force that compresses any spacer 100*a-h*, the set of spacers 120 maintains portions of shroud material 15 proximate to where each spacer attaches to shroud material 15 distant from a surface 107 for chest region 105.

The set of spacers 120 also maintains shroud material 15 between individual spacers 100 distant from the surface 107 of chest region 105. In one embodiment, the set of spacers 120 is suitably numbered and individual spacers 100 are sized such that, in the absence of a force that compresses any spacer 100*a-h* or collapses shroud material 15 between spacers 100, the set of spacers 120 prevents shroud material 15 from contacting the outside surface 107 of chest region 105 for the entire perimeter of chest region 105 (when the person's arms are lifted). In a specific embodiment, individual spacers 100 in set 120 are positioned at high contour areas around chest region 105 such that a spacing distance, D, between shroud material 15 and chest region 105 is substantially maintained for shroud material 15 around the entire perimeter. It is understood that shroud material 15 is flaccid and may be manipulated by external forces such that portions of shroud material 15 momentarily or intermittently contact the surface 107 of chest region 105. Once the forces are removed, shroud material 15 portions between spacers 100 typically return to their position distant from surface 107 of chest region 105.

As a result of the separation distance provided by spacers 100, channels 115 are formed within apparel 10 between individual spacers 100 and between portions of person 11 and inner portions of apparel 10. Channels described herein refer to spaces within apparel 10 that permit the flow of air therethrough. Cumulatively, numerous channels 115 inside apparel 10 may store a significant volume of air, the benefits of which will be described below. Referring to FIG. 2A, channels 115 are bordered by shroud material 15, surface 107 of chest region 105, and sides 103 of each spacer 100. For example, channel 115*a* comprises space within apparel 10 formed between spacer 100*a*, spacer 100*b*, shroud material 15 between proximate portions of spacer 100*a* and spacer 100*b*, and a portion of surface 107 between distal portions spacer 100*a* and spacer 100*b*. Similarly, the set of spacers 120 create and maintain eight airflow channels 115*a-h* arranged circumferentially about chest region 105.

Inner surfaces of shroud material 15 are thus spaced away from person 11 to provide multiple airflow channels 115 within apparel 10. This arrangement permits airflow and cooling circulation around person 11 with minimal airflow resistance, which facilitates cooling of the person 11 proximate to channels 115 and eases the travel of fresh air in apparel 10 for breathing. In one embodiment, individual spacers 100 are dimensioned and a set of spacers configured to maintain an average distance, D, between inner portions of apparel 10 and portions of person 11 (FIG. 2A). An average distance from about ½ inch to about 4 inches is suitable in some applications. In another embodiment, spacers in a set are configured to maintain an average distance from about 1 inch to about 2 inches between the inner surface of shroud material 15 and person 11. Smaller and larger average separation distances are also possible. The separation distance provided by each spacer 100 may vary with where the spacer is located relative to person 11, a desired amount of airflow desired for the portion of person 11 proximate to the spacer 100, and whether the spacer 100 may potentially inhibit movement for person 11. For example, spacers 100 arranged on the outside of a leg may provide a larger separation distance than those arranged on the inside of the leg to minimize any interference on the legs during walking (FIG. 2C).

FIG. 2B illustrates an exemplary set of spacers 140 that is arranged circumferentially about a waist region 111 of person 11 when the person wears apparel 10. The set of spacers 140 comprises eight spacers 100*i-p* arranged about waist region 111. In the absence of a force that compresses any spacer 100*i-p*, the set of spacers 140 maintains portions of shroud material 15 proximate to where each spacer attaches to shroud material 15 distant from a surface 117 of waist region 111. The set of spacers 140 also maintains shroud material 15 between individual spacers 100 distant from the surface 117 of waist region 111. In one embodiment, the set of spacers 140 is suitably numbered and individual spacers 100 are sized such that, in the absence of a force that compresses any spacer 100*i-p*, the set of spacers 140 prevents shroud material 15 from contacting the outside surface of waist region 111 for the entire perimeter of waist region 111. The set of spacers 140 thus maintain eight airflow channels 115*a-h* arranged circumferentially about waist region 111.

FIG. 3B illustrates a top perspective view of a spacer 100 used in sets 120 and 140. A height 140 and a width 142 are used herein to describe dimensions of spacer 100. Width 142 may be reduced to increase the cross-sectional area of channels 115. Alternatively, width 142 of either proximate portion 102 or distal portion 104 may be enlarged to increase the stability of spacer 100 in maintaining a constant position relative to person 11. Height 140 may also be reduced to increase space for channels and air movement within apparel 10. In one embodiment, spacer 100 has a height from about ¼ inches to about 8 inches. In another embodiment, spacer 100 has a height from about 1 inch to about 4 inches. Each spacer 100 has slightly curved surfaces for distal portion 104 and proximate portion 102. When the spacer neighbors a curved portion of person 11, such as a shoulder portion, the spacer 100 is arranged on shroud material 15 such that the curvature of distal portion 104 resembles the local curvature of the person.

Cumulatively, the set of spacers 120 shown in FIG. 2A and the set of spacers 140 shown in FIG. 2B maintain shroud material 15 vertically between the set of spacers 120 and the set of spacers 140 distant from the torso of person 11. Given the relatively small height or volume of individual spacers 100, air channels are then formed vertically between the circumferentially arranged spacer sets 120 and 140. In other words, spacer sets 120 and 140 maintain shroud material 15 away from the torso of person 11 for a majority of the torso, including vertical portions between spacer sets 120 and 140. This permits relatively easy air travel around the torso of person 11 within apparel 10. Apparel 10 may also include shoulder spacers that maintain shroud material 15 distant from the shoulders of person 11. Apparel 10 may further include spacers that maintain shroud material 15 distant from the buttocks and thighs of person 11. Cumulatively, the spacers arranged throughout apparel 10 maintain shroud material 15 away from person 11 according to the number, size and location of spacers employed.

In addition to improved heat management, the large volume of air within apparel 10 facilitates breathing. As will be described in further detail below, shroud material 15 included in hood 20 opens directly into this torso volume of space. In this case, the spacers 100 provide a buffer volume 190 of air that allows a person to breath without incurring uncomfortable pressure changes. The buffer volume comprises space internal to apparel 10 between the person and inner surfaces of shroud material 15. Since the human respiratory capacity of one breath is generally about 0.5 liters, the large volume of air allows person 11 to take a breath without observing a substantial pressure change within apparel 10, as is common in many conventional protection apparel that do not include a large interior volume of air. Spacer sets 120 and 140 thus facilitate breathing within apparel 10 by reducing pressure fluctuations in the apparel during breathing. One or more spacers 100 may be employed and configured to establish a neck channel that permit low resistance airflow between the inside of hood 20 about the person's face and a buffer volume in body portion 12. Low resistance airflow within the channels permits air to be readily moved through the apparel and improves breathing ease by allowing the person to draw air from the buffer volume with negligible effort.

FIG. 2B also illustrates the positioning of blower 38 and inlet filter 30. In one embodiment, blower 38 and inlet filter 30 are arranged such that fresh air provided by blower 38 flows into a channel 115. As shown in FIG. 2B, blower 38 and inlet filter 30 are arranged such that blower 38 provides air into channel 11151. This allows cooling and fresh air inlet with minimal resistance into the interior of apparel 10. Given the relatively small cross-sectional area or volume of individual spacers 100, spacer sets 120 and 140 thus provide a large volume of space and air within body portion 12 and apparel 10. In other words, when numerous spacers 100 maintain a majority of shroud material 15 away from the torso of person 11, including the shoulders and buttocks, this allows blower 38 to provide inlet cool air into a large volume internal to apparel 10, thereby providing relatively cool inlet air to cool a large surface of person 11.

Individual spacers 100 may be arranged to increase comfort of a full body suit. For example, channels 115*a* and 115*e* are arranged such that the arms of person 111 may rest in their natural position as the sides of person 11 without regular interference from a spacer 100. Channels 115*a* and 115*e* also permit forward and back motion of each arm without physical interference from a spacer 100, which is useful during walking.

Spacers 100 may also combine with natural movement of person 11 to facilitate cooling. More specifically, spacers 100 allow natural movements of person 11 to create pressure disturbances within the environment internal to apparel 10. The pressure disturbances move air within apparel 10, through channels 115, and across the body of person 11—thereby cooling person 11. For example, when person 11 lifts an arm, motion of the arm away from a position where person 11 has his arms at his sides creates a local negative pressure disturbance that moves air within apparel 10. This local negative pressure in channel 115*e* draws air into channel 115*e*, thereby cooling the portion of person 11 in this region. The movement also moves the air within apparel 10 from locations in apparel 10 where the air originated, cooling person 11 in these regions. Local pressure disturbances are not limited to movement of person 11 and may be the result of disturbances to shroud material 15. Thus, external forces that move shroud material 15 around channel 115*e* may also move air for passive cooling of person 11. Alternatively, when person 11 returns his right arm to his side such that channel 115*e* collapses, this creates a local positive pressure that pushes air out of channel 115*e*, thereby moving air into other portions and channels 115 of apparel 10 affected by the local pressure increase. In general, any movements of person 11 and/or shroud material 15 may cause local disturbances move air to and cool of person 11. Indeed, an advantage of the present invention is that natural motions by the torso of person 11 may lead to air movement within body portion 12, such as those associated with walking and twisting. Since the muscles of person 11 that move a person's torso are relatively large, this allows a passive form of air distribution and cooling within apparel 10 that requires minimal added effort from person 11. For example, walking may lead to considerable air movement and circulation within apparel 10, thereby passively cooling person 11.

A set of spacers 100 as described herein includes any number of spacers configured to maintain apparel 10 proximate to the spacers distant from one or more portions of person 11. In one embodiment, apparel 10 comprises from 1 spacer to about 200 spacers. In a specific embodiment, apparel 10 comprises numerous small spacers—over 100, each of about an inch or less. In another embodiment, apparel 10 comprises from about 20 spacers to about 50 spacers.

A set of spacers may be locally defined and established for particular portions of person 11, such as sets 120 and 140 described above for chest region 105 and waist region 111, respectively. Spacers and spacers sets may also be arranged proximate to other portions of person 11 to maintain apparel proximate to the spacer and spacer set distant from a portion of the person, such as a buttocks portion, leg portions such as the thighs, knees and calves, a head or a neck portion, and arm portions such as the upper arm, elbows and forearms, etc. In a specific embodiment, a set of spacers is arranged circumferentially about a buttocks region of person 11 when the person wears apparel 10, similar to the arrangement shown in FIG. 2B. Generally, spacers 100 may be arranged anywhere on apparel 10 such that they neighbor a desired portion of person 11 to maintain apparel proximate to the spacers distant from the portion of person 11. Portions of person 11 with high curvature where shroud material 15 would normally be expected to come in contact with person 11 are well suited. In one embodiment, a set of spacers is arranged to neighbor a high contour portion (shoulders, buttocks, outside portions of arms and legs, etc.) of person 11 such that the spacing distance, D, between shroud material 15 and portion of person 11 is substantially maintained for shroud material 15 around the high contour portion. Thus, in the absence of a force that compresses the spacers, the set of spacers 120 prevents shroud material 15 from contacting the high contour portion. In another embodiment, the number and density of spacers increases when neighboring a high contour portion of person 11.

While FIGS. 2A and 2B are illustrated with spacers 100 of the same size and shape, it is understood that spacers 100 employed in apparel 10 are not limited to common sizing or shaping. In one embodiment, spacers 100 may be sized and shaped to provide a localized interface between apparel 10 and person 11.

FIG. 2C illustrates a vertical cross section of person 11 and apparel 10 taken through a thigh region 109 of the person's right leg in accordance with one embodiment of the present invention. A set of spacers 160 arranged on shroud material 15 about thigh region 109 includes two sizes of spacers: smaller spacers 100*p* and 100*q* arranged on the inner side of thigh region 109, and larger spacers 100*r* and 100*s* arranged on the outer side of thigh region 109. Smaller spacers 100*p* and 100*q* minimize any interference on the legs of person 11 during walking. In the absence of a force that compresses any spacer 100*p-s*, the set of spacers 160 maintains portions of shroud material 15 proximate to where each spacer attaches to shroud material 15 distant from a surface of the person's right leg for the entire leg perimeter. A similar arrangement as that shown in FIG. 2C may be used on other portions of pant leg 26, such as at the knee or calf. The spacers 100 at these portions may be smaller than those employed for set 160. Similarly, a smaller set of spacers may be arranged to neighbor outer portions (away from the body) of an arm for person 11.

Spacers 100 may also employ other shapes than that shown in FIGS. 3A and 3B. In other embodiments, spacer 100 is shaped to resemble a cylinder, a cone, a cube, a rectangular block, a truncated right angle cone body (or frustum), a truncated right pyramid with a square or rectangular base for distal portion 102, a ball-shape, or a hemisphere, etc. FIG. 3C illustrates a top perspective view of a spacer 150 in accordance with another embodiment of the present invention. Spacer 150 comprises substantially square distal and proximate surfaces 102 and 104, respectively. Any one of the side dimensions for spacer 150, such as height 152, may match the thickness of an off the shelf foam sheet. The simple shape of spacer 150 simplifies manufacture of numerous spacers 150. In one embodiment, numerous spacers 100 are manufactured from commercially available and inexpensive foam sheets, thereby simplifying manufacture and reducing cost of apparel 10. In a specific embodiment, one side of the sheet comprises a peel adhesive that allows the adhesive to be applied to all the spacers before cutting to further simplify manufacture.

Figure 2D:
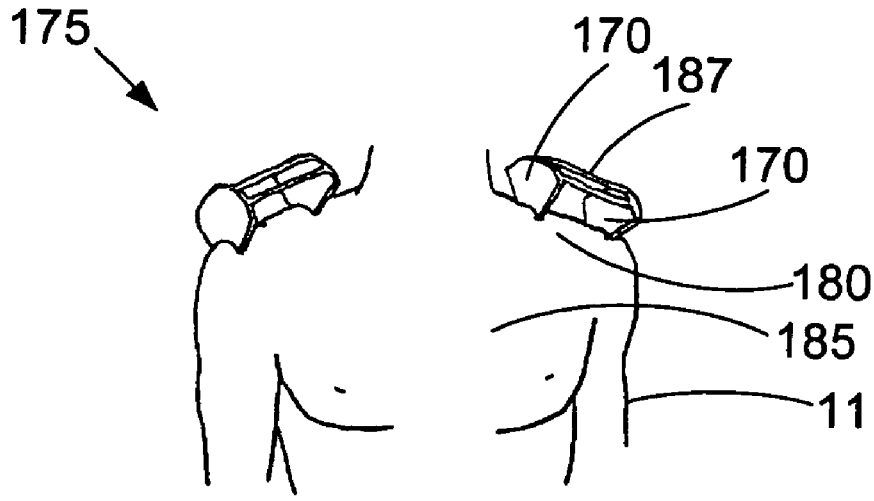
FIG. 2D illustrates a top perspective view of the arc shoulder spacers of FIG. 3D positioned on a shoulder portion of a person in accordance with another embodiment of present invention.
Figure 3D:
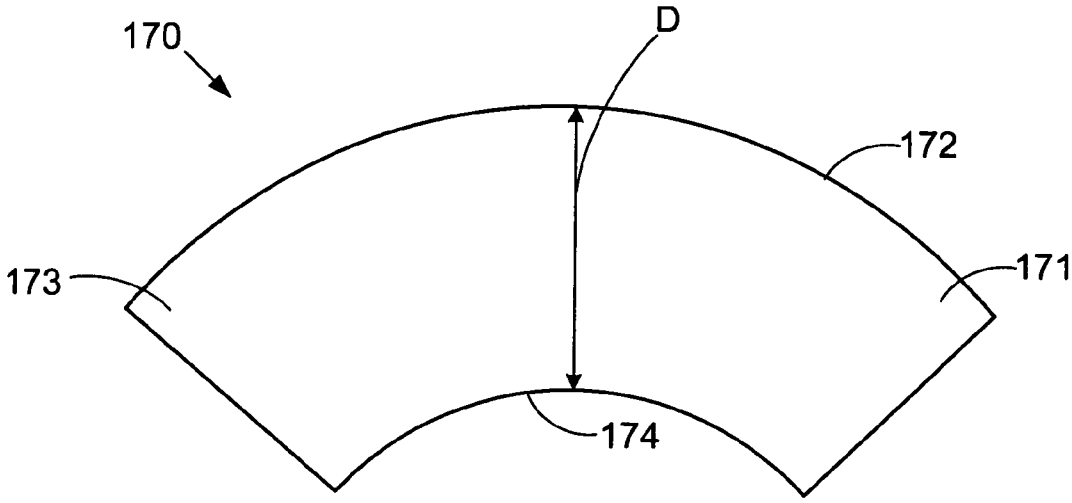
FIG. 3D illustrates arc shoulder spacers in accordance with another embodiment of present invention.

It is also contemplated that different spacers 100 within apparel 10 may also include different shapes. FIG. 3D illustrates a shoulder spacer 170 in accordance with another embodiment of present invention. FIG. 2D illustrates a top perspective view of a set of four shoulder spacers 175 positioned on a shoulder portion 180 of person 11 in accordance with another embodiment of present invention. Other portions of person 11 and apparel 10, such as shroud material 15, have been omitted from of FIG. 2D to facilitate illustration.

Referring initially to FIG. 2D, the set of shoulder spacers 175 is arranged on apparel 10 such that two spacers 175 rest on each left and right side of the person's neck. Referring to FIG. 3D, each shoulder spacer 170 comprises a proximate surface 172 and distal surface 174. Distal surface 174 rests upon the shoulders 180 of person 11 when person 11 wears apparel 10. Shroud material 15 of apparel 10 thus rests upon the proximate surface 172 shoulder spacers 170. In one embodiment, shoulder spacer 170 comprises compressible foam that allows the distal portion 174 of each spacer 170 to conform to the shape of the person's shoulders. Thus, based on the weight of shroud 15, local portions of distal surface 174 compress and conform to the contour of the person's shoulders. Curved and compliant distal surfaces 174 increase surface area interface with the top portion of shoulders 180, thereby minimizing localized and potentially uncomfortable forces on the shoulders.

Each shoulder spacer 170 is shaped and dimensioned such that shroud material 15 proximate to each shoulder spacer 170 maintains an average distance, D, from the shoulders of person 11. As shown in FIG. 3D, spacers 170 are dimensioned such that this average distance extends normal to shoulders 180 from the back of shoulders 180, over the top of shoulders 180, to the front of shoulders 180. More specifically, a front portion 171 of shoulder spacers 170 is dimensioned to extend out from the front of the person's shoulders such that the average distance is maintained in front of the shoulders 180. If a set of spacers is arranged in the chest region 105, such as set 120 described with respect to FIG. 3D, the set of spacers 175 (FIG. 2A) and set 120 cumulatively maintain shroud material 15 away from an upper chest portion 185 of the person. Similarly, a back portion 173 of shoulder spacers 170 extends out from the back of shoulders 180 such that the average distance is maintained in a back portion of the shoulders. Again, if a set of spacers is arranged in the back portion of the chest, the set of spacers 175 (FIG. 2A) and chest set cumulatively maintain shroud material 15 away from an upper back portion of the person. Air channels are formed between each shoulder spacer 170, and between spacers 170 in set 175 and any spacers 100 in the chest region (FIG. 2A).

In one embodiment, the set of shoulder spacers 175 includes support members 187 arranged between adjacent spacers 175. Support members 187 attach to adjacent spacers 175 and substantially prevent relative motion between the adjacent spacers. Support members 187 comprise a thin, lightweight and rigid material, such as a suitably stiff plastic. As shown, two support members 187 are attached to the proximate portion 172 of each spacer 170, between shroud material 15 and the proximate portion 172, so as to not interfere with airflow in channels between the set of spacers 175. In another embodiment, a single and thicker support member 187 is attached between adjacent spacers 175 instead of multiple support members 187.

Figure 2E:
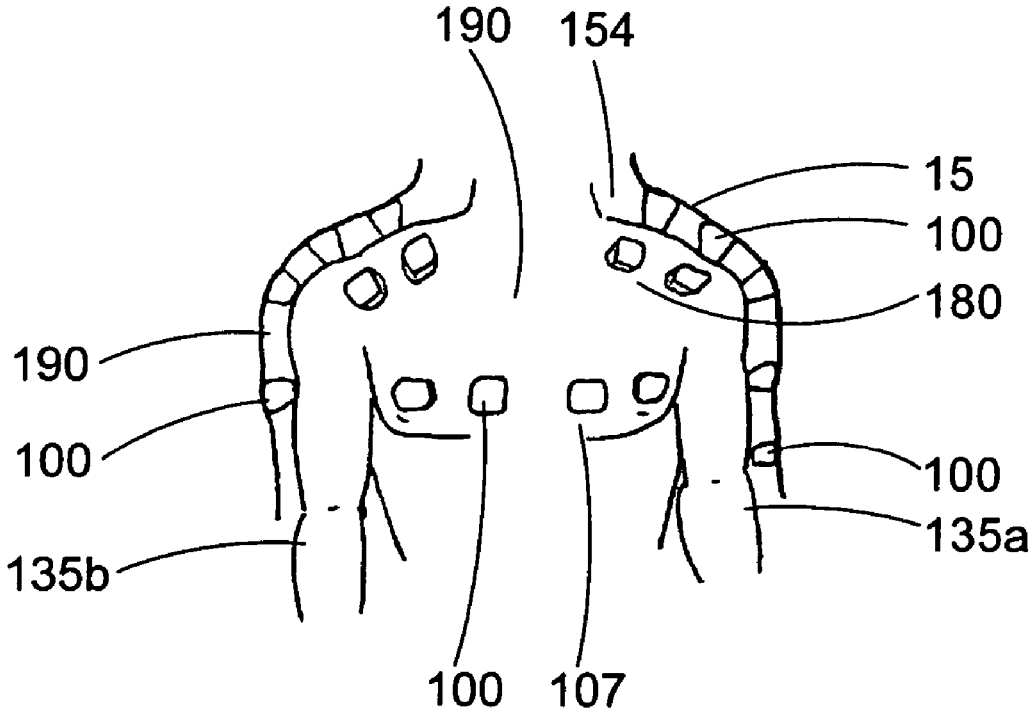
FIG. 2E illustrates a front view of shoulder spacers positioned about the chest, arms and shoulders of a person in accordance with another embodiment of present invention.

FIG. 2E illustrates a front view of spacers 100 positioned about chest region 105, arms 135*a* and 135*b* and shoulders 180 of a person in accordance with another embodiment of present invention. In this case, a set of spacers is arranged on apparel 10 to neighbor the lateral outside of shoulders 180 and arms 135*a* and 135*b*. The spacers 100 permit low resistance airflow in an upper portion of sleeves 14 and over an upper portion of the person's arms 135*a* and 135*b*; and permits low resistance airflow between air channels in an upper portion of sleeves 14 and air channels in the upper areas of body portion 12 and shoulder regions. The spacers 100 also create a buffer volume 190 within a large upper region of body portion 12, including space between an upper portion of sleeves 14 and an upper portion of the person's arms 135*a* and 135*b*; and space between air channels in the upper areas and shoulders of body portion 12.

Figure 2F:
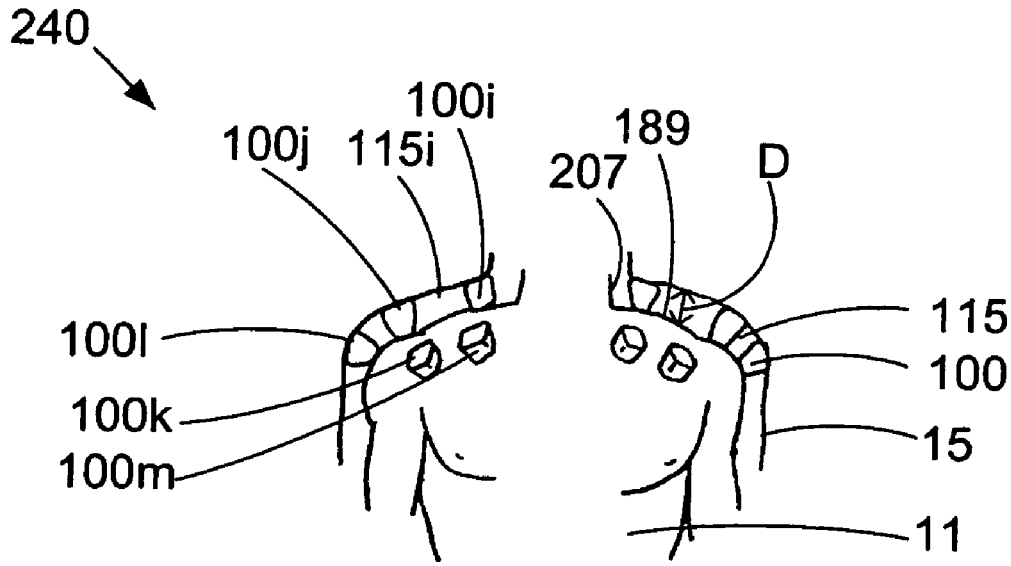
FIG. 2F illustrates a front view of shoulder spacing arrangement and spacers resting on shoulders of a person in accordance with another embodiment of present invention.
Figure 2G:
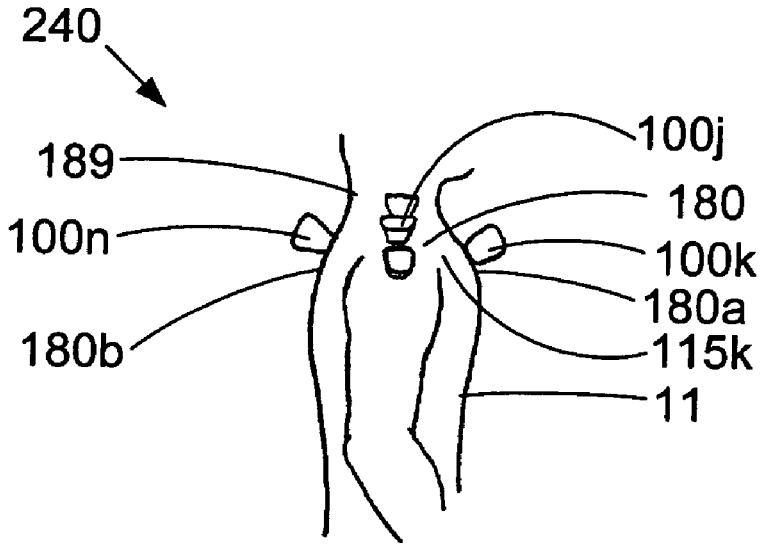
FIG. 2G illustrates a side view of the shoulder spacing arrangement of FIG. 2F in accordance with one embodiment of the present invention.
Figure 2H:
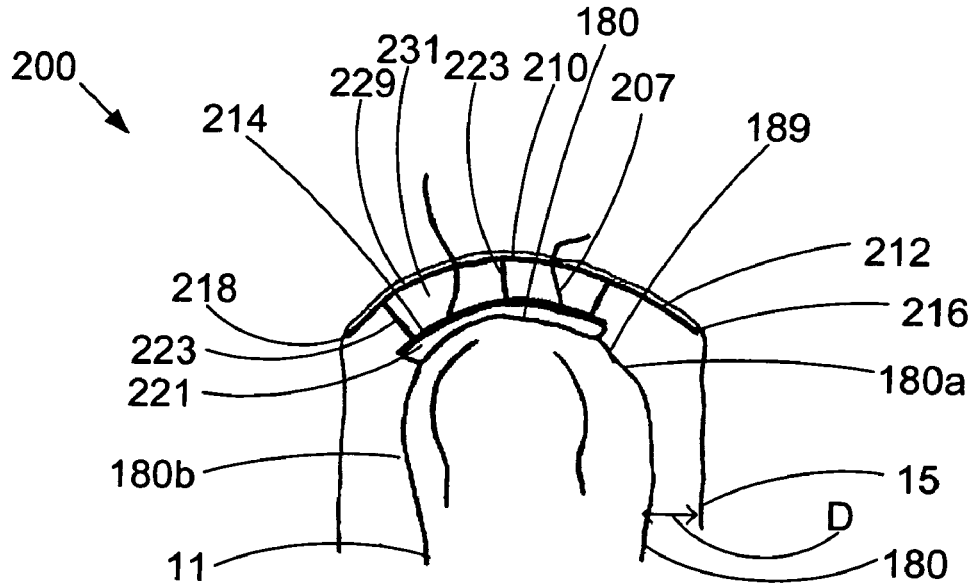
FIG. 2H illustrates a side view of a single extended shoulder spacer resting upon the shoulders of a person in accordance with one embodiment of the present invention.

FIGS. 2F-2G illustrate a shoulder spacing arrangement 240 including a set of spacers 100 in accordance with another embodiment of the present invention. FIG. 2F illustrates a front view of shoulder spacing arrangement 240 and spacers 100 resting upon shoulders 180 of person 11. FIG. 2G illustrates a side view of shoulder spacing arrangement 240 and spacers 100 resting upon the shoulders 180 of person 11 in accordance with one embodiment of the present invention. Portions of shroud material 15 have been omitted from FIGS. 2F-2G to facilitate illustration.

Referring to FIG. 2F, shoulder spacing arrangement 240 maintains a portion of shroud material 15 proximate to the shoulder spacing arrangement 240 distant from the person's shoulders 180. Specifically, each spacer 100 is arranged to maintain shroud material 15 proximate to the spacer 100 distant from an outer surface 189 of shoulders 180. Spacers 100 also maintain shroud material 15 between the spacers 100 distant from an outer surface 189 of shoulders 180. Each spacer 100 includes a body 101 having a proximate portion 102 (FIG. 3A) that attaches to an inner portion of apparel 10 and a distal portion 104 (FIG. 3A) that neighbors shoulders 180 when person 11 wears apparel 10.

Distal portion 214 or 104 is arranged to rest upon the person's shoulders 180 when person 11 wears apparel 10. 'Resting upon' as the term used herein refers to the spacers laying on the shoulders and/or being supported by the shoulders. Since gravity pulls shroud material 15 downward when person 11 stands, and shoulders 180 counter the weight via the spacers, distal portion 214 or 104 is normally in contact with the shoulders 180. However, depending on the size of person 11, fit of apparel 10 and the temporary relationship between person 11 and apparel 10, distal portion 214 or 104 may be closely situated to shoulders 180, or relatively removed from shoulders 180.

Shoulder spacing arrangement 240 employs numerous modular spacers 100 to maintain a shroud material 15 proximate to the shoulder spacing arrangement 240 distant from the person's shoulders 180. As shown, shoulder spacing arrangement 240 comprises fourteen shoulder spacers 100: seven spacers 100*i-o* to the left of neck 207 and seven spacers 100 to the right of neck 207. Of the seven spacers on each side, three spacers 100 are arranged on shroud material 15 to rest upon the top contour of shoulders 180, two spacers 100 are arranged on shroud material 15 to rest upon the front portion 180*a* of shoulders 180, and two spacers 100 are arranged on shroud material 15 to rest upon the back portion 180*b* of shoulders 180.

In this case, individual spacers 100 are positioned around shoulders 180 such that a spacing distance, D, between shroud material 15 and shoulders 180 is substantially maintained for shroud material 15 about shoulders 180. It is understood that shroud material 15 is compliant and may be manipulated by external forces such that portions of shroud material 15 momentarily or intermittently contact the surface 189 of shoulders 180. However, once the forces are removed, shroud material 15 returns to its position distant from surface 189 of shoulders 180.

As a result of the separation distance provided by spacers 100, channels 115 are formed within apparel 10 between individual spacers 100 and between portions of person 11 and inner portions of apparel 10. Referring to FIG. 2F, channels 115 are bordered by shroud material 15, surface 189 of shoulders 180, and sides 103 of each spacer 100. For example, channel 115*i* comprises space within apparel 10 formed between spacer 100*i*, spacer 100*j*, shroud material 15 between proximate portions of spacer 100*i* and spacer 100*j*, and a portion of surface 189 between distal portions spacer 100*i* and spacer 100*j*. Similarly, channel 115*k* (FIG. 2G) comprises space within apparel 10 formed between spacer 100*k*, spacer 100*j*, shroud material 15 between proximate portions of spacer 100*k* and spacer 100*j*, and a portion of surface 189 between distal portions spacer 100*k* and spacer 100*j*. In addition, shoulder spacing arrangement 240 creates and maintains numerous other channels 115 arranged between spacers 100 that rest upon shoulders 180.

In one embodiment, belts, elastic banding and other fasteners may be used to change the fit of shroud material 15 and apparel 10. For example, a belt with two strips of material for tying or a belt with an adjustable clasp may be arranged about the set of spacers 140. The belt allows person 11 to alter the diameter and fit of shroud material 15 about person 11, thereby decreasing any excess shroud material 15 about person 11 and increasing the fit of apparel 10. This also situates spacers 100 closer to person 11, or in contact therewith. The spacers will maintain the distance between shroud material 15 and person 11 according to their size, and maintain any respective air channels. Elastic banding arranged in the clothing about a circumferentially arranged set of spacers also acts to constrict shroud material 15 to conform with a particular size of person 11. Plastic tape may also be used to allow person 11 to adjust fit for particular portions of shroud material 15 and apparel 10.

Numerous spacers within apparel 10—such as those described in sets 120, 140 and 175—may provide a large network of low resistance airflow channels within apparel 10. Blower 38 then moves cool inlet air through a large network of low resistance channels. This constant and easy supply of fresh inlet air across a large surface of person 11 eases heat management for the person. In one embodiment, shroud material 15 in the lower region of hood 20 opens directly into the space provided by spacers in the shoulder and chest region of person 11. Air inlet using blower 38 and air outlet arranged in the top of hood 20 creates an airflow system of relative high pressure at the inlet and relative low pressure in outlet. This results in continuous net airflow in through inlet filter 30, over portions of the waist, over portions of the chest, over portions of the shoulders, over portions of the neck, over the face and head 85 of person 11, and out the air outlets 32.

A person wearing protective apparel often produces moisture in the apparel via perspiration and breathing. Due to the relationship between moisture and temperature in air, excess moisture in a contained environment may lead to thermoregulation issues. In one embodiment, one or more desiccants are arranged within apparel 10 to reduce moisture levels in the apparel. The predictable net airflow patterns within apparel 10 may then be used to also assist moisture management within apparel 10. More specifically, desiccants may be arranged in airflow channels that guide air and moisture within the apparel, thereby permitting the strategically located desiccants to passively absorb moisture in apparel 10. In a specific embodiment, desiccants are attached to the inner surfaces of shroud material adjacent to spacers 100 (FIG. 2E), thereby decreasing moisture within the apparel and increasing comfort of the apparel when worn for prolonged periods.

Protective apparel of the present invention finds wide use in shielding a wearer from an undesirable agent. Generally, the present invention finds use in any environment where a person wears protective clothing to defend from an undesirable agent. Undesirable agents may include gaseous or liquid agents, biological and/or chemical molecules, microorganisms, airborne contaminants that are in a gaseous, liquid or solid state, and other substances that the person wants minimal or no exposure to. Thus, health-care practitioners working in environments where biological agents are probable may benefit from wearing apparel described herein. Apparel 10 is well suited to defend against threats related to SARS, ebola, anthrax, flu, and other airborne or droplet based threats. Apparel 10 is also well suited for use in other environments such as those associated with chemical and industrial environments where user contamination is to be minimized or avoided.

Protective apparel as described herein is also well suited for prolonged usage. Nurses commonly wear protective apparel for hours at a time, and thus may benefit from the present invention. There are numerous other applications in which a health-care practitioner or another individual benefits from protective apparel that is used to shield the person from a biological or chemical agent. For example, health care practitioners treating individuals that generate an airborne biological agent, such as a virus associated with a respiratory illness, may benefit from the full coverage protective apparel described herein. Alternatively, surgeons and other surgical staff in an operating room may rely on defense provided by protective apparel described herein against a liquid agent during surgery.

In addition, the present invention also addresses the dual function of preventing transfer of undesirable agents from the person wearing the apparel to environments and persons outside the apparel. Thus, apparel described herein may include exhaust filters that filter air passing out from the apparel and is thus well suited for use by nurses and other practitioners in an operating room or surgical environment to protect a surgery patient. Apparel 10 is also well suited for use in low contamination rooms and other places such as "clean rooms". The latter is common in the semiconductor industry where contamination contributions by occupants are to be reduced.

As described herein, a buffer volume 190 (FIG. 2E) refers to a contiguous space within apparel 10. In one embodiment, the buffer volume 190 within apparel 10 mainly comprises space within the apparel created by spacers 100, such as channels 115. Other areas within apparel 10 may also contribute to the buffer volume, including spaces within hood 20. In one embodiment, the buffer volume 190 within apparel 10 includes a volume of at least about four liters. In another embodiment, spacers 100 and channels 115 create a buffer volume 190 within apparel 10 of at least about seven liters. In an even more spacious embodiment, the buffer volume 190 within apparel 10 includes a volume of at least about ten liters. The buffer volume 190 may also vary with the fit of apparel 10 and the size of person 11. Apparel 10 may also be designed according to a sizing scheme (S, M, L) that approximates a buffer volume in the apparel greater than about ten times the respiratory capacity of a person for that size (based on an average respiratory capacity of 0.5 liters). In this manner, pressure for the buffer volume does not change by more than about ten percent during a normal inhalation.

Channels 115 within apparel 10 may be linked to provide a large buffer volume 190. In the absence of a force that compresses any spacer 100, the spacers 100 maintain channels 115 and buffer volume 190, as well as maintain low resistance airflow communication within the buffer volume. When the channels 115 in body portion 12 open into a neck airflow channel 154 (FIG. 2E) that provides low resistance airflow to the mouth and nose of person 11, the buffer volume 190 allows person 11 to inhale and exhale without incurring uncomfortable pressure changes. Neck airflow channel 154 comprises channels formed by spacers 100 between the chest of person 11 and the head of person 11, and may receive spacing contributions from spacers 100 on the shoulders of person 11 or the upper chest.

Figure 6:
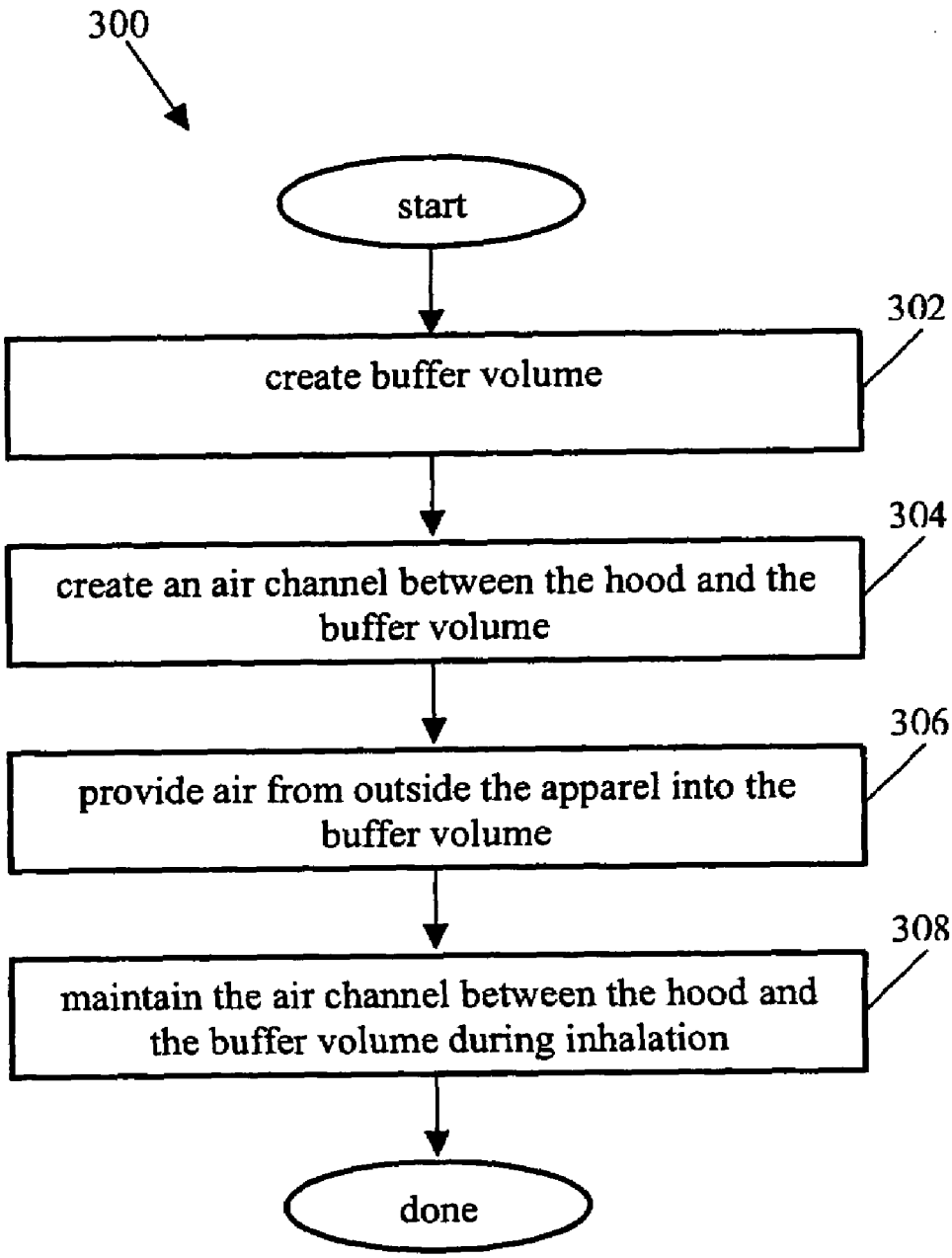
FIG. 6 illustrates a process flow for maintaining an environment internal to protective apparel in accordance with one embodiment of the invention.

FIG. 6 illustrates a process flow 300 for maintaining an environment internal to protective apparel in accordance with one embodiment of the invention. Process flow 300 begins by creating a buffer volume of air within a body portion 12 of the apparel (302). Numerous spacers within apparel 10—such as those described in sets 120 and 140—provide a buffer volume comprising numerous low resistance airflow channels within body portion 12 and other internal portions apparel 10.

Process flow 300 continues by creating an air channel between a space inside hood 20 and the buffer volume 190 (304). One or more spacers 100 configured to neighbor a neck of the person creates a neck air channel 154 for apparel 10. Channel 154 permits easy low resistance movement between the buffer volume in body portion 12 into and out of hood 20. Blower 38 then moves fresh air from outside the apparel into the buffer volume 190 (306). Coupled with channel 154, this constant supply of fresh air into a large buffer volume, including the upper body, head and neck, eases breathing for person 11.

The spacers 100 also maintain air channel 154 between the space inside the hood and the buffer volume during an inhalation by the person (308). Inhalation may include a partial or full inhalation. In one embodiment, spacers 100 are arranged to maintain a distance of no less than one inch in neck air channel 154 during inhalation of person 11. Air inlet using blower 38 arranged near hood 20 creates an airflow system of relative high pressure in hood 20. This results in continuous net airflow into hood 20, through neck air channel 154, into body portion 120 and out any outlet filters disposed in body portion 12.

In another embodiment, the present invention also comprises one or more airflow directing spacers that are configured to direct airflow within the apparel.

Figure 5A:
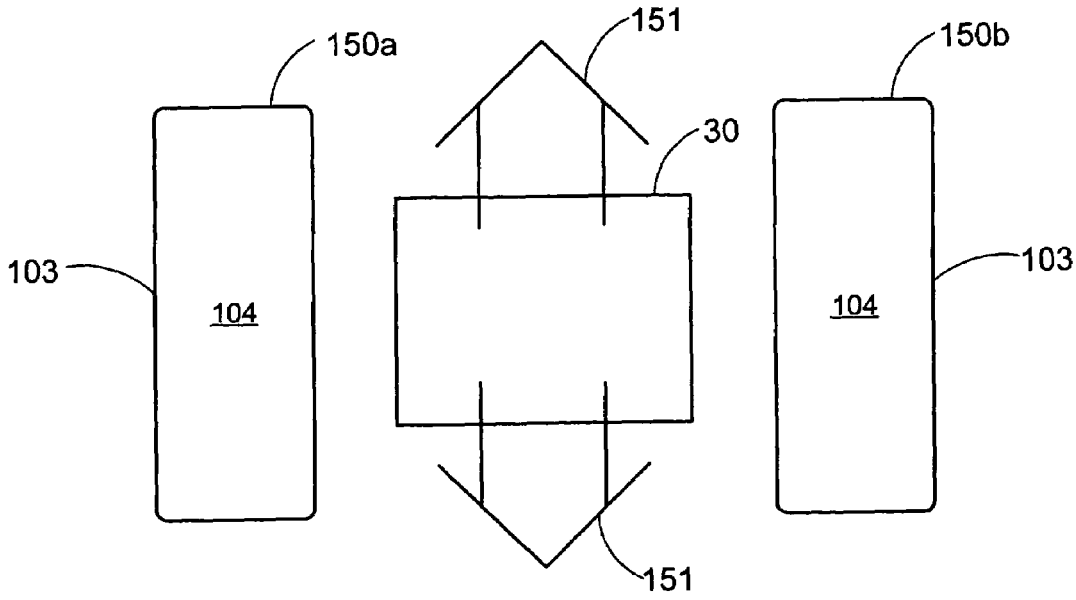
FIG. 5A shows a schematic of dual airflow directing spacers with the shroud material removed to facilitate illustration in accordance with one embodiment of present invention.

FIG. 5A shows a schematic of dual airflow directing spacers 150*a* and 150*b* in accordance with one embodiment of present invention. Person 11 and other portions apparel 10 have been omitted from of FIG. 5A to facilitate illustration. Airflow directing spacers 150*a* and 150*b* are arranged on left and right sides of inlet filter 30, respectively. Proximate portions for each spacer 150*a* and 150*b* attach to an inner portion of shroud material 15 on either side of the aperture for filter 30. Distal portions for each spacer 15 neighbor a portion of person 11 corresponding to the placement of each spacer 15 on apparel 10 and the fit of apparel 10. For the embodiment shown in FIG. 1, distal portions for each spacer 150*a* and 150*b* neighbor a lower torso of person 11 on both lateral sides of inlet filter 30. In another embodiment, spacers 150*a* and 150*b* neighbor an inlet filter 30 disposed on the back side of apparel 10. Spacers 150 are similar in shape to that described above with respect to FIG. 3C, and include a rectangular shape with substantially orthogonal surfaces and roughly flat surfaces for distal portion 104 and proximate portion 102.

Filtered air passes through inlet filter 30—as moved by a blower (e.g., FIG. 2B)—into an air channel formed between the two spacers 150*a* and 150*b*, shroud material 15 between the two spacers 150*a* and 150*b*, and the torso of person 11 between spacers 150*a* and 150*b*. The body of person 11 proximate to inlet filter 30 acts as a large wall that redirects air perpendicular to its inlet direction. Left airflow directing spacer 150*a* prevents air provided through inlet filter 30 from moving immediately left. Right airflow directing spacer 150*b* prevents air provided through inlet filter 30 from moving immediately right. Cumulatively, the body of person 11, the inside surface of shroud material 15, and spacers 150*a* and 150*b* substantially direct air provided through inlet filter 30 upwards and downwards from the air inlet. Airflow arrows 151 approximate the resultant airflow. For apparel 10, upwards moving air cools the torso of person 11, and downwards moving air cools the groin and legs of person 11 before returning upwards to cool other portions of person 11 before exhaust.

Spacers 150*a* and 150*b* also prevent inlet filter 30 and the blower from contacting person 11 by providing support on both lateral sides of the blower. In some cases where the blower hangs from shroud material 15 (e.g., it is velcroed onto the shroud material), spacers 150*a* and 150*b* maintain blower 38 from contacting person 11—and maintain the air channel 1151 (between the spacers 150, shroud material 15 and person 11) that services the blower.

Thus, airflow directing spacers 150 maintain portions of apparel 10 proximate to the spacers distant from person 11. Portions of apparel 10 kept from continuous contact with person 11 may include shroud material 15, inlet filter 30, blower 38, or any portions and components of apparel 10 in proximity to a spacer 150.

Figure 5B:
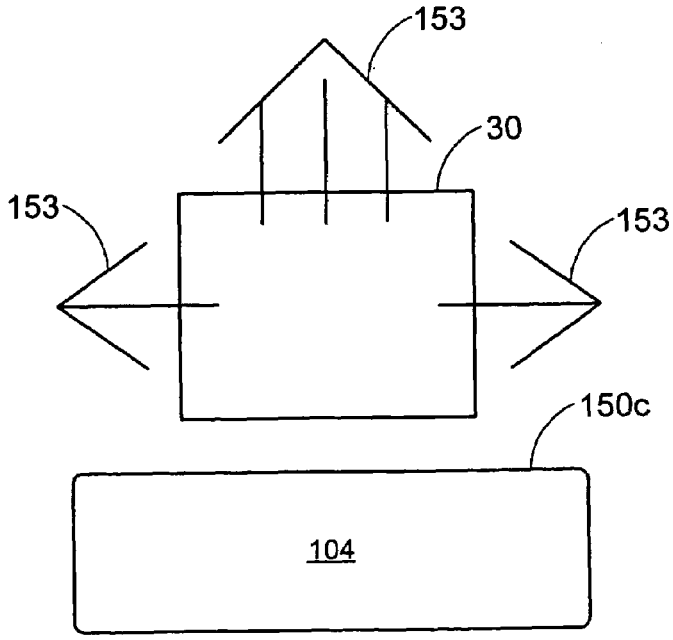
FIG. 5B shows a schematic of an airflow directing spacer disposed below an air inlet, with the shroud material removed to facilitate illustration, in accordance with another embodiment of present invention.

FIG. 5B shows a schematic of an airflow directing spacer 150*c* disposed below an air inlet 30, with shroud material 15 removed to facilitate illustration, in accordance with another embodiment of present invention. Airflow directing spacer 150*c* is arranged below inlet filter 30, attaches to an inner portion of shroud material 15 below the aperture for filter 30, and neighbors a torso or waist portion of person 11 when person 11 wears apparel 10. Spacer 150*c* includes substantially rectangular surfaces for distal portion 104 and proximate portion 102 and substantially parallel sides that extend therebetween.

Airflow directing spacer 150*c* prevents some air provided through inlet filter 30 from moving immediately downwards. In other words, spacer 150*c* creates a higher pressure below filter 30 that facilitates movement of inlet air in directions other than down. Correspondingly, the body of person 11 and spacer 150*c* direct more air provided through inlet filter 30 upward and to the left and right of the air inlet. Airflow arrows 153 approximate the resultant airflow. Spacer 150*c* may also prevent inlet filter 30 and blower 38 from contacting person 11 by providing support below blower 38.

Figure 5C:
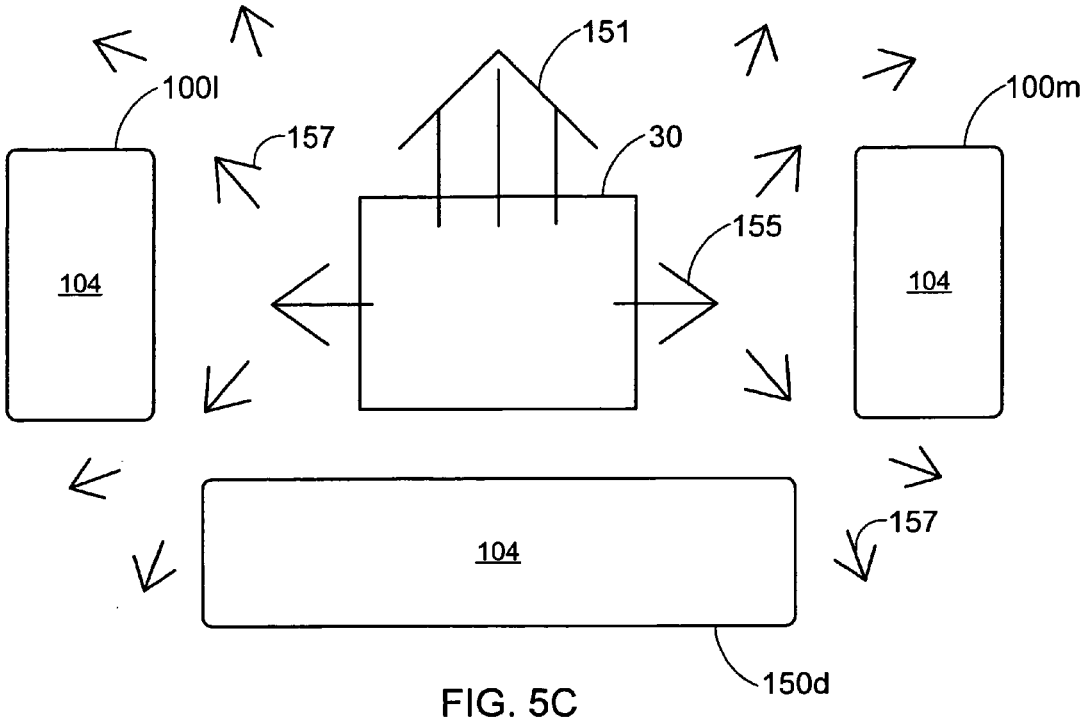
FIG. 5C shows a schematic of an airflow directing spacer in relation to two spacers, with the shroud material removed to facilitate illustration, in accordance with one embodiment of present invention.

FIG. 5C shows a schematic of an airflow directing spacer 150*d* in relation to two waist spacers 1001 and 100*m* of FIG. 2B, with shroud material 15 removed to facilitate illustration, in accordance with one embodiment of present invention. As shown in FIGS. 5C and 2B, inlet filter 30 is positioned to direct air into a channel 151*l* between two spacers 100*l* and 100*m*. Similar to the airflow directing spacer 150*c* of FIG. 5C, spacer 150*d* is arranged below inlet filter 30 and prevents air provided through inlet filter 30 from moving immediately downwards. However, spacer 150*d* is also larger in its width dimension and therefore redirects a greater amount of air upwards and to the lateral directions. Airflow arrows 155 approximate the resultant airflow directed by spacer 150*d*. For the arrangement shown in FIG. 5C, spacers 100*l* and 100*m* also act to redirect air moving laterally towards each spacer, although with less effect than spacer 150*d*. Airflow arrows 157 approximate the resultant airflow directed by spacers 100.

Figure 5D:
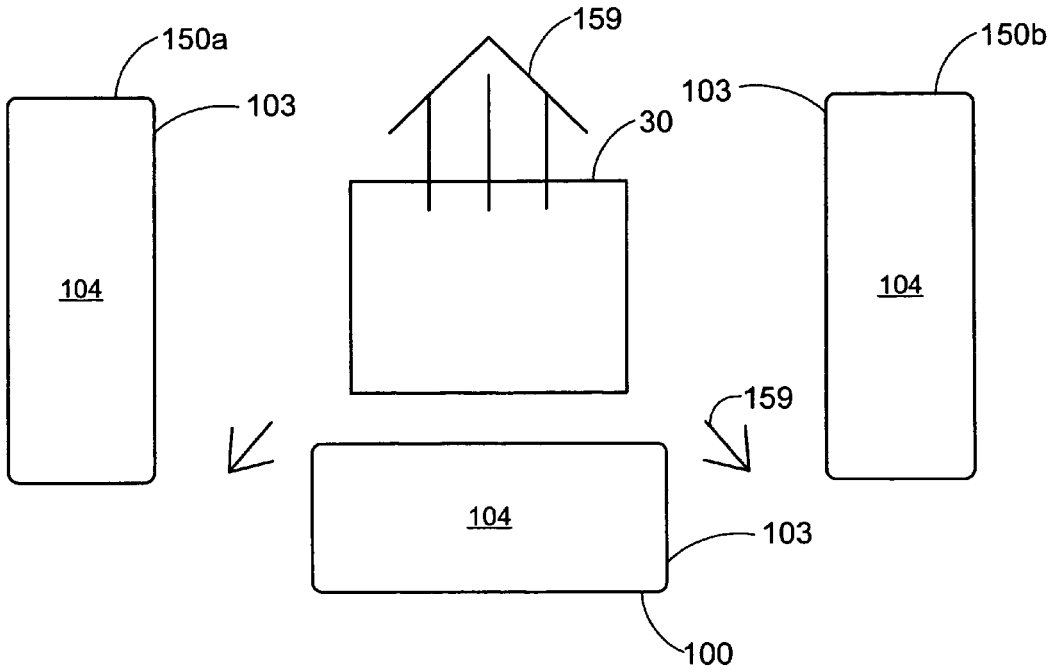
FIG. 5D shows a schematic of an arrangement of airflow directing spacers disposed about an air inlet, with the shroud material removed to facilitate illustration, in accordance with another embodiment of present invention.

FIG. 5D shows a schematic of an arrangement 250 of airflow directing spacers 150*a*, 150*b* and 100 disposed about an air inlet 30, with shroud material 15 removed to facilitate illustration, in accordance with another embodiment of present invention. Airflow directing spacers 150*a* and 150*b* were described above with respect to FIG. 5A. Spacer 100 has been described above with respect to FIGS. 3A and 3B. In this case, spacers 150*a*, 150*b* and 100 cooperate to substantially direct air provided through inlet filter 30 upwards from the air inlet. Airflow arrows 159 approximate the resultant airflow directed by spacers 150*a*, 150*b* and 100. Shaping air inflow in this manner allows the majority of air provided through inlet filter 30 to travel upwards.

Similarly, arrangement 250 may be manipulated such that the spacers cooperate to direct air in another direction, e.g., downward, to a side, at a desired angle, etc. Shaping air inflow for a specific air inlet 30 in this manner is advantageous when multiple blowers are used, and the air inflow of one blower 38 may be directed within apparel 10 to cool specific portions of person 11, as desired. Spacers 150*a*, 150*b* and 100 also prevent inlet filter 30 and blower 38 from contacting person 11 by providing support on both lateral sides of, and below, a blower. This maintains the blower from contacting person 11, and by maintains the air channel that services the blower.

The size, shape, and/or position of a spacer 150 may be adapted to achieve a desired airflow affect. More specifically, a spacer 150 proximate to inlet filter 30 may be enlarged to redirect a larger proportion of airflow, or decreased for an opposite effect. For example, spacer 150*d* of FIG. 5C is substantially larger than spacer 150*c* of FIG. 5B, and thus prevents a larger proportion of air provided through inlet filter 30 from moving immediately downwards. In addition, the proximity of a spacer 150 to inlet filter 30 may be increased to redirect a larger proportion of airflow, or decreased for an opposite effect. Spacer 150 may also be curved and otherwise shaped to achieve a desired local airflow effect. For example, although the embodiment shown in FIG. 5D shows three separate spacers, it is contemplated that a single spacer that spans three sides of inlet filter 30 may be implemented.

Although airflow directing spacers 150 have primarily been described with respect to positioning proximate to inlet filter 30, it is understood that spacers 150 may be employed in any location within apparel 10 where it is desirable to direct airflow within apparel 10 and maintain shroud material 15 proximate to the spacer distant from the person. Thus, any of the locations described above with respect to spacers 100 are suitable if the spacer 100 also functions to direct airflow.

In another embodiment, apparel 10 may also employ less modular shoulder spacing arrangements with or without spacers 100 or 150. The shoulder spacing arrangements prevent continuous contact between the shoulder of person 11 and portions of apparel 10, form air channels within apparel 10 that allow air to move through apparel 10 with relatively little resistance, and improve heat management within apparel 10.

Figure 2I:
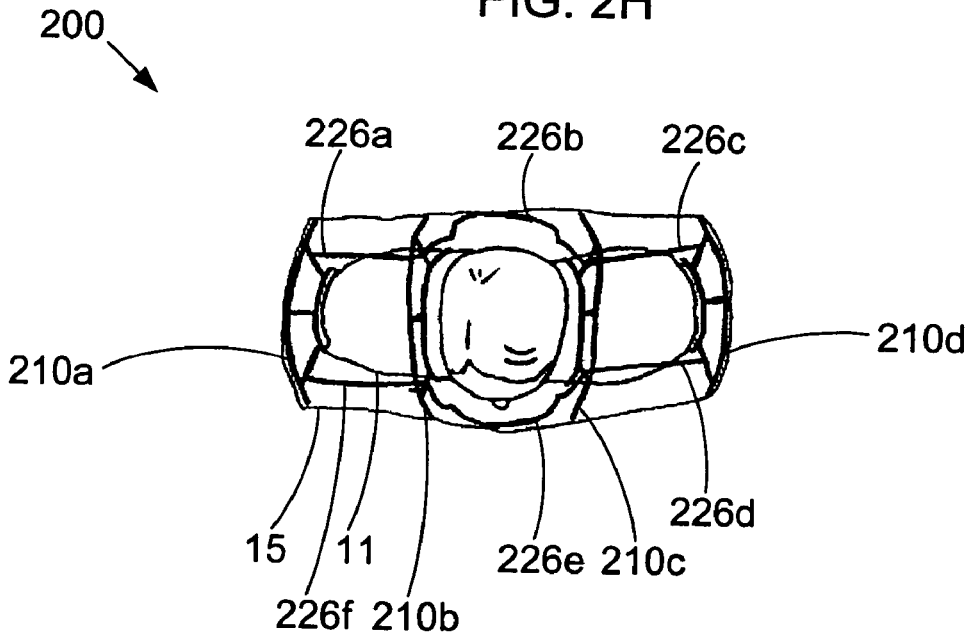
FIG. 2I illustrates a top view of a shoulder spacing arrangement that includes four extended shoulder spacers of FIG. 2H resting upon the shoulders of a person in accordance with one embodiment of the present invention.
Figure 2J:
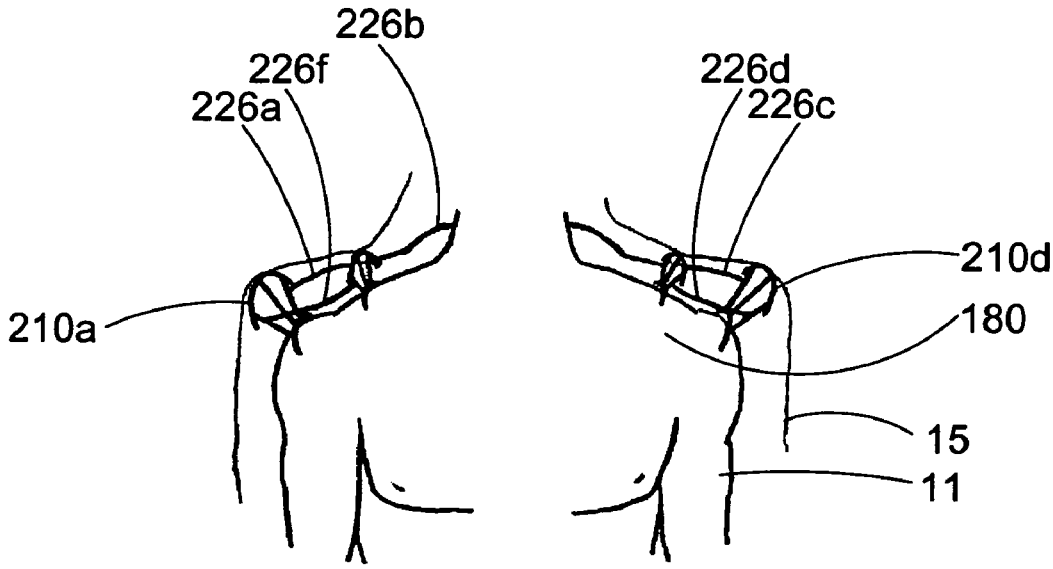
FIG. 2J illustrates a front view of the shoulder spacing arrangement of FIG. 21 in accordance with one embodiment of the present invention.

FIGS. 2G-2J illustrate a shoulder spacing arrangement 200 including extended shoulder spacers 210 in accordance with one embodiment of the present invention. FIG. 2G illustrates a side view of a single extended shoulder spacer 210*b* resting upon the shoulders 180 of person 11 in accordance with one embodiment of the present invention. FIG. 2I illustrates a top view of shoulder spacing arrangement 200 and extended shoulder spacers 210 resting upon the shoulders 180 of person 11. FIG. 2J illustrates a front view of shoulder spacing arrangement 200 and extended shoulder spacers 210 in accordance with one embodiment of the present invention. Portions of shroud material 15 and apparel 10 have been omitted from FIGS. 2G-2J to facilitate illustration.

Referring to FIG. 2G, shoulder spacing arrangement 200 maintains a portion of shroud material 15 proximate to the shoulder spacing arrangement 200 distant from the person's shoulders 180. Specifically, each extended shoulder spacer 210 is arranged to maintain shroud material 15 proximate to the spacer 210 distant from an outer surface 189 of shoulders 180. Each spacer 210 includes a body 211 having a proximate portion 212 (FIG. 2G) that attaches to an inner portion of apparel 10 and a distal portion 214 (FIG. 2G) that rests upon shoulders 180 when person 11 wears apparel 10. Spacers 210 also maintain shroud material 15 between the spacers 210 distant from an outer surface 189 of shoulders 180. As shown in FIG. 2G, each extended shoulder spacer 210 has a double arch structure with curved surfaces for distal portion 214 and proximate portion 212.

Shoulder spacing arrangement 200 comprises four extended shoulder spacers 210, with two spacers 210 resting upon shoulders 180 on the left side of the person's neck 207 and two spacers 210 resting upon shoulders 180 on the right side of the person's neck. Referring to FIG. 2G, each extended shoulder spacers 210 comprises a proximate portion 212, distal portion 214, front portion 216, back portion 218, and body portion 229.

Distal portion 214 is a surface that rests upon the shoulders 180 of person 11 when person 11 wears apparel 10. Distal portion 214 curves to substantially match the upper contour of a person's shoulder, and may be varied to accommodate numerous users. Proximate portion 212 is a surface that shroud material 15 attaches to and rests upon. Proximate portion 212 is also curved such that each shoulder spacer 210 maintains an average distance, D, from the shoulders 180 of person 11 to proximate portion 212. In another embodiment, proximate portion 212 is substantially straight and the distance, D, to shoulders 180 varies.

In one embodiment, a compressible material layer 221 is attached to the bottom side of distal portion 214. The compressible material layer 221 is designed in stiffness and thickness to slightly deform based on the weight of shroud 15. Thus, based on the weight of shroud 15, local portions of the compressible material under distal portion 214 compress and the compressible material layer 221 conforms to the contour of the person's shoulders 180. This increases surface area interface with the top portion of shoulders 180 and minimizes localized and potentially uncomfortable forces on shoulders 180. A compressible foam or sponge is suitable for use with compressible material layer 221.

Front portion 216 extends away from a front portion 180*a* of shoulders 180 when the person 11 wears apparel 10 (FIG. 2G). Shroud material 15 then drapes from the frontmost edge of front portion 216 down to any chest spacers located below front portion 216 (FIG. 3C). Back portion 218 extends away from a back portion 180*b* of shoulders 180 when the person 11 wears apparel 10. Shroud material 15 also drapes from the backmost edge of back portion 218 down to any chest spacers located below back portion 218.

A body portion 229 for each extended shoulder spacer 210 is defined between distal surface 214 and proximate surface 212. In this case, body portion 229 comprises spacing arms 223 that separate proximate portion 212 from distal portion 214. Body portion 229 for spacer 210 includes a thin aspect ratio, defined as the ratio of the front/back length to the thickness of material between distal portion 214 and proximate portion 212. In one embodiment, body portion 229 has an aspect ratio between about 2:1 and about 15:1. Body portion 229 also comprises a hollow portion 231 between spacing arms 223 that reduces the weight of spacer 210 and allows airflow perpendicular to the longer front/back length. Spacing arms 223, proximate portion 212, distal portion 214, front portion 216, back portion 218, and support members 187 may comprise a thin, lightweight and rigid material, such as a suitably stiff plastic.

The amount of distance between front portion 216 and front shoulders 180*a*, back portion 218 and back shoulders 180*b*, and between proximate portion 212 and the top of shoulders 180 (the length of spacing arms 223), are all controlled by design. In one embodiment, each extended shoulder spacer 210 is shaped and dimensioned such that shroud material 15 proximate to each shoulder spacer 210 maintains an average distance, D, from the shoulders 180 of person 11. As shown in FIG. 2A, spacers 210 are dimensioned such that this average distance extends normal to shoulders 180 from back portion 180*b*, over the top of shoulders 180, to the front portion 180*a*. More specifically, front portion 216 of spacer 210 is dimensioned to extend out from the front portion 180*a* such that the average distance is maintained in a front portion 180*a* of shoulders 180. If a set of spacers is arranged in the chest region 105, such as set 120 described with respect to FIG. 3C, the shoulder spacing arrangement 200 (FIG. 2G) and set 120 cumulatively maintain shroud material 15 away from an upper chest portion 185 of the person. Similarly, back portion 218 of extended shoulder spacer 210 extends out from a back portion 180*b* of shoulders 180 such that the average distance is maintained in a back portion 180*b* of the shoulders 180. Again, if a set of spacers is arranged in the back portion of the chest, the shoulder spacing arrangement 200 (FIG. 2G) and chest spacer set cumulatively maintain shroud material 15 away from an upper back portion of the person. Air channels are then formed between each extended shoulder spacer 210, and vertically between spacers 210 and any spacers 100 in the chest region (FIG. 2G).

In one embodiment, the shoulder spacing arrangement 200 includes support members 226*a-f* arranged between adjacent spacers 210. Support members 226 attach to adjacent spacers 210 and substantially prevent relative motion between the adjacent spacers. For example, support member 226*a* attaches to a back spacing arm 223 on adjacent spacers 210*a* and 210*b*. Support member 226*f* attaches to a front spacing arm 223 on spacers 210*a* and 210*b*. In one embodiment, two support members 226 are attached to the proximate portion 214 of each spacer 210, between shroud material 15 and the proximate portion 214, so as to not interfere with airflow in channels between the set of spacers 210. In another embodiment, a single and thicker support member 226 is attached between two adjacent spacers 210 instead of multiple support members 226.

Figure 2K:
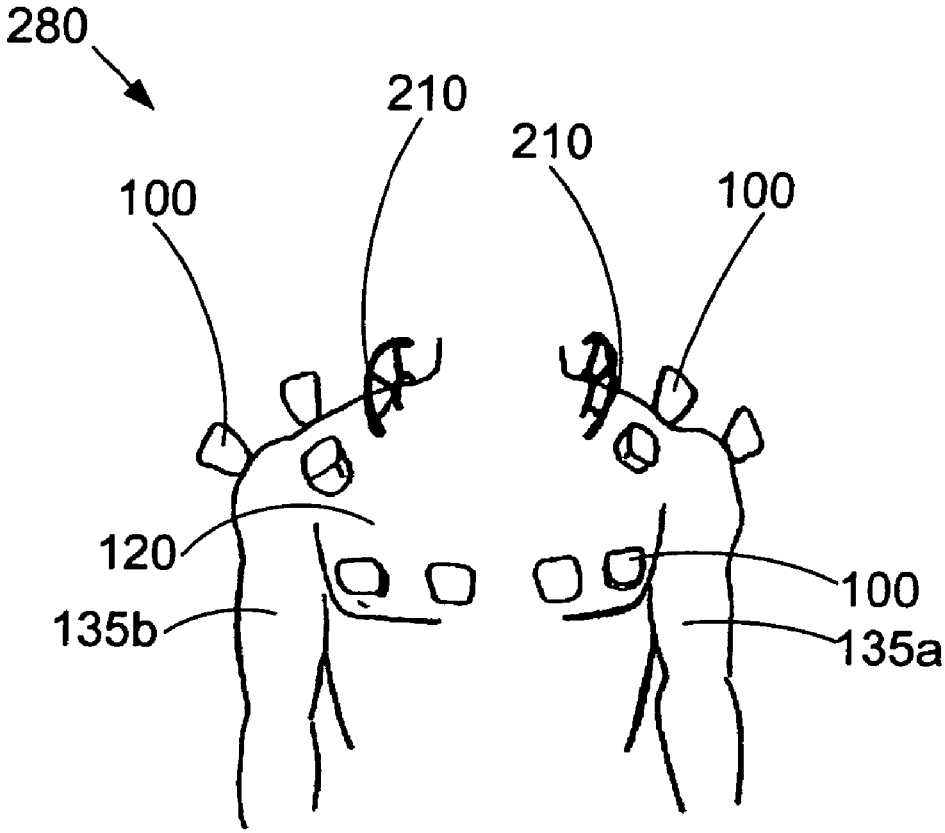
FIG. 2K illustrates a front view of a shoulder spacing arrangement in accordance with another embodiment of the present invention.

FIG. 2K illustrates a front view of a shoulder spacing arrangement 280 and other spacers used in an upper portion of apparel 10 in accordance with another embodiment of the present invention. Shoulder spacing arrangement 280 comprises two extended shoulder spacers 210 and eight spacers 100: four spacers 100 to the left of neck 207 and four spacers 100 to the right of neck 207. Of the four spacers 100 on each side, two rest upon a top portion of shoulders 180, one rests upon a front portion 180*a* of shoulders 180, and one rests upon a back portion 180*b* of shoulders 180. Extended spacers 210 are arranged inside of spacers 100. Spacers 100 are arranged on the lateral outside of spacers 210 since spacers 100 may conform better to varying sizes of persons that wear apparel 10.

In one embodiment, the protective apparel is fully closed such that entry and exit of gases and liquids into and out from an environment internal to the apparel is controlled for the entire body of person 11, as is shown in FIG. 1. In another embodiment, the protective apparel does not provide protection to every portion of its wearer. In this case, the apparel may not include gloves attached to the distal ends of the sleeves, sleeves that extend only to a wearer's elbows, an open viewing window 24 with no solid protection, no head coverage, no boots, and/or no pants, etc. Thus, advantages of the present invention may be achieved with apparel that only covers portions of the person and not the entirety.

In one embodiment, apparel 10 is disposable. In some cases, all portions of apparel 10 are disposable except the blower, its associated power source and the headgear assembly. These parts may be separated before disposal. Disposable apparel benefits health care environments and hospitals since practitioners may rid of contaminated materials readily. In addition, disposable apparel offers increased portability to remote environments.

Although the foregoing invention has been described in some detail for purposes of clarity of understanding, those skilled in the art will recognize that various modifications may be made within the scope of the appended claims. For example, although the present invention has been described with respect to a garment assembly that provides full body coverage, one of skill in the art will appreciate that advantages of the present invention may be realized in a suit that covers less than the entire body. In addition, although the present invention has primarily been described with respect to compressible and compliant spacers 100, a collapsible material such as cardboard may also be used. The collapsible cardboard may have a hollow and frustoconical shape, for example. The invention is, therefore, not limited to the specific features and embodiments described herein and claimed in any of its forms or modifications within the scope of the appended claims.

What is claimed is:

1. Protective apparel comprising:

shroud material included in a body portion of the apparel for covering at least a portion of a person's torso when the person wears the apparel;

a hood that includes a viewing window and hood shroud material that attaches to the viewing window; and a set of compliant spacers configured to maintain a buffer volume of air within the body portion between the shroud material included in the body portion and the person when the person wears the apparel, wherein the buffer volume includes a volume of at least about 2 liters, wherein the set of compliant spacers includes a set of compliant neck spacers that is configured to a) maintain neck shroud material included in the apparel distant from a neck portion of the person when the person wears the apparel and b) create an air channel, between the buffer volume in the body portion and a space inside the hood, that allows the person wearing the apparel to inhale air in the buffer volume.

2. The apparel of claim 1 further including an air inlet arranged near the hood to facilitate airflow from the hood to the buffer volume.

3. The apparel of claim 1 each compliant spacer in the set includes a compressible foam.

4. The apparel of claim 1 wherein each spacer in the set is attached to an inner surface of the shroud material.

5. The apparel of claim 1 further comprising a filter that intercepts air before inlet into the buffer volume.

6. The apparel of claim 1 wherein the set of compliant spacers form a set of air channels that permit the movement of air within the buffer volume.

7. The apparel of claim 1 wherein the buffer volume comprises at least about 4 liters.

8. The apparel of claim 7 wherein the buffer volume comprises at least about 7 liters.

9. The apparel of claim 1 wherein the set of compliant spacers includes a set of chest spacers arranged to circumferentially border a chest portion of the person when the person wears the apparel.

10. The apparel of claim 9 wherein the buffer volume comprises space provided by the set of chest spacers between a portion of the person proximate to the set of chest spacers and a portion of the shroud material proximate to the set of chest spacers.

11. The apparel of claim 1 wherein the set of compliant spacers includes a set of shoulder spacers arranged about a shoulders portion of the person when the person wears the apparel.

12. Protective apparel comprising:

shroud material included in a body portion of the apparel for covering at least a portion of a person's torso when the person wears the apparel;

a hood that includes a viewing window and hood shroud material that attaches to the viewing window;

a set of compliant spacers that maintain a buffer volume of air within the body portion between the shroud material included in the body portion and the person when the person wears the apparel, wherein the buffer volume includes a volume of at least about 2 liters; and an air channel between a space inside the hood and the buffer volume in the body portion that allows the person wearing the apparel to inhale air in the buffer volume.

13. The apparel of claim 12 wherein the set of compliant spacers are configured to maintain the air channel when the person wears the apparel.

14. A method of maintaining an environment internal to protective apparel, the method comprising:

using a set of compliant spacers, creating a buffer volume of air within a body portion of the apparel between shroud material included in the apparel and the person when the person wears the apparel, wherein the buffer volume includes a volume of at least about 2 liters;

creating an air channel between the buffer volume and a space inside a hood included in the apparel;

providing air from outside the apparel into the buffer volume;

permitting air, from the buffer volume, to be inhaled by the person; and maintaining the buffer volume of at least about 2 liters during an inhalation by the person.

15. The method of claim 14 further comprising maintaining an air channel between the space inside the hood and the buffer volume during an inhalation by the person.

16. The method of claim 14 wherein the set of compliant spacers form a set of air channels that allow air to move within the buffer volume.

17. The method of claim 14 further comprising filtering air before inlet into the buffer volume.

18. The method of claim 14 wherein the buffer volume comprises at least about 4 liters.

19. The method of claim 18 wherein the buffer volume comprises at least about 7 liters.

* * * * *